US008314739B2

(12) United States Patent
Kuramoto

(10) Patent No.: US 8,314,739 B2
(45) Date of Patent: Nov. 20, 2012

(54) WIDEBAND ANTENNA

(75) Inventor: Akio Kuramoto, Minato-ku (JP)

(73) Assignee: NEC Corporation, Tokyo (JP)

( * ) Notice: Subject to any disclaimer, the term of this patent is extended or adjusted under 35 U.S.C. 154(b) by 369 days.

(21) Appl. No.: 12/597,670

(22) PCT Filed: Apr. 25, 2008

(86) PCT No.: PCT/JP2008/058080

§ 371 (c)(1),
(2), (4) Date: Oct. 26, 2009

(87) PCT Pub. No.: WO2008/136414

PCT Pub. Date: Nov. 13, 2008

(65) Prior Publication Data

US 2010/0141541 A1 Jun. 10, 2010

(30) Foreign Application Priority Data

Apr. 27, 2007 (JP) ..... 2007-118619

(51) Int. Cl.
*H01Q 1/12* (2006.01)

(52) U.S. Cl. ..... 343/718; 343/700 MS

(58) Field of Classification Search ..... 343/718, 343/700 MS, 795, 793
See application file for complete search history.

(56) References Cited

U.S. PATENT DOCUMENTS 6,356,238 B1 3/2002 Gainor et al.
6,600,454 B1 7/2003 Moilanen
6,621,457 B1 9/2003 Adams et al.
6,972,725 B1 12/2005 Adams
7,002,526 B1 2/2006 Adams et al.
2004/0201522 A1 10/2004 Forster
2005/0035919 A1 * 2/2005 Yang et al. ..... 343/795
2006/0119525 A1 6/2006 Cohen et al.

FOREIGN PATENT DOCUMENTS

JP 6-152219 A 5/1994
JP 2002-280817 A 9/2002
JP 2002-538649 A 11/2002
JP 2003-309418 A 10/2003
JP 2004-295466 A 10/2004

(Continued)

OTHER PUBLICATIONS

Masato Tanaka et al., "Wearable Patch Antenna" IEICE Technical Report, Jul. 2002, pp. 1-8, vol. 102, No. 232.

(Continued)

*Primary Examiner* — Hoanganh Le
(74) *Attorney, Agent, or Firm* — Sughrue Mion, PLLC

(57) ABSTRACT

A wideband antenna includes a first radiating element and a second radiating element which are substantially in the same shape of a flat plate. A first side of the first radiating element is parallel to a second side of the second radiating element. Moreover, the first and second radiating elements are so arranged as to be shifted from each other with part of the first side facing part of the second side. If the first and second radiating elements thus arranged are moved in parallel so that the first and second sides face each other and are parallel to each other, the first and second sides substantially have line symmetry.
Electricity is supplied to the first and the second radiating elements at a predetermined position where part of the first side faces part of the second side.

18 Claims, 27 Drawing Sheets

FOREIGN PATENT DOCUMENTS

| | | | |
|---|---|---|---|
| JP | 2005-042223 | A | 2/2005 |
| JP | 2005-130292 | A | 5/2005 |
| JP | 2005-192050 | A | 7/2005 |
| JP | 2006-309401 | A | 11/2006 |
| JP | 2007-318323 | A | 12/2007 |

OTHER PUBLICATIONS

European Search Report issued Apr. 24, 2012 in counterpart European application No. 08752125.8.

* cited by examiner

WIDEBAND ANTENNA

TECHNICAL FIELD

The present invention relates to a wideband antenna, and particularly relates to a planar and thin wideband antenna having a broad bandwidth. The present application claims priority from Japanese Patent Application No. 2007-118619 filed on Apr. 27, 2007, the contents of which being incorporated herein by reference.

BACKGROUND ART

In recent years, various outdoor wireless service systems, such as mobile phones, hot spot services of wireless LAN (local area network) and WiMAX (worldwide interoperability for microwave access), have become available. Moreover, in the broadcasting sector, the digital terrestrial television broadcasting and the like have started. In order to effectively make use of such various wireless services, it is important to improve performance of antennas.

On the other hand, wideband antennas are required for the terminals supporting the above-mentioned services. Moreover, the terminals used for the above-mentioned services have been increasingly downsized. The problem is a decline in sensitivity of the antennas inside the terminals.

An effective technique to solve the problem is a wearable antenna to be attached to clothing or bodies. If an antenna can be attached to clothing, a relatively large antenna can be formed to solve the sensitivity problem. However, since human bodies are conductive, it is difficult to realize an antenna that can effectively operates near a human body.

Non-Patent Document 1: The Institute of Electronics, Information and Communication Engineers, "Proceedings of Technical Committee on Antennas and Propagation," (Technical Report of IEICE AP2002-76)

DISCLOSURE OF THE INVENTION

Problems to be Solved by the Invention

By the way, a planar and thin antenna which has a broad bandwidth and is able to supply electricity without using direct soldering and to maintain good matching characteristics even near a human body appears to be not available.

For example, as a wideband antenna, there is a discone antenna as illustrated in FIG. 1.

The antenna illustrated in FIG. 1 has a three-dimensional shape formed by a combination of a conductive circular plate 501 and a conductive circular cone 502, to obtain the broadband characteristic. The antenna is equipped with a coaxial cable 503, a coaxial central conductor 504 and a coaxial external conductor 505.

Moreover, the antenna has a complex shape in such a way that the coaxial cable 503 enters from the lower side of the circular cone 502 and is connected to the central portion for supplying electricity.

However, it is difficult to form the structure with conductive fabrics. Also, there is no case in which the antenna shows good matching characteristics when being placed near a human body. Moreover, a method of supplying electricity without the use of direct soldering has not been known before.

As another example of an antenna which is formed by a conductive fabric and can be placed near a human body, there is a fabric patch antenna as illustrated in FIG. 2.

The antenna illustrated in FIG. 2 is disclosed in Non-Patent Document 1.

More specifically, the antenna is equipped with a patch element 601 made of a conductive fabric, a ground 602, and an insulating fabric 603 serving as an insulator.

Since the antenna disclosed in Non-patent Document 1 is made of fabrics, the antenna can be freely flexed and attached to clothing. However, only a very narrow band characteristic can be obtained.

Accordingly, the antenna disclosed in Non-patent Document 1 may be a wideband antenna which can be placed near a human body but cannot obtain a broadband characteristic.

The present invention has been made in view of the above problems. An objective of the present invention is to provide a wideband antenna that can be placed near a human body, maintain the input impedance and obtain a broadband characteristic.

Means for Solving the Problems

According to the present invention, an exemplary wideband antenna includes a first radiating element and a second radiating element, each of the first and second radiating elements including at least one side and being in the shape of a flat plate, wherein one side of the first radiating element faces one side of the second radiating element so that the sides are parallel to each other, and the first and second radiating elements are so arranged as to be shifted from each other in the parallel direction.

Advantages of the Invention

According to the present invention, even when the wideband antenna of the present invention is placed near a human body, the input impedance characteristic does not deteriorate. Moreover, the planar and thin wideband antenna can maintain the broadband characteristic.

EXPLANATION OF REFERENCE SYMBOLS

Figure 2:
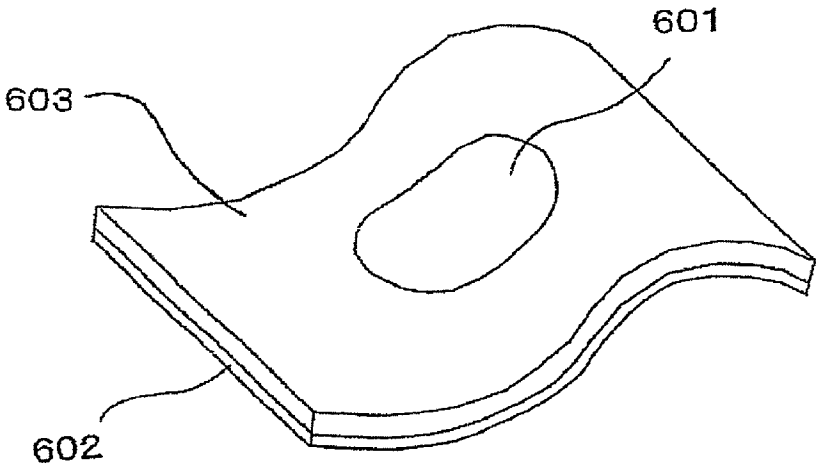
FIG. 2 is a diagram illustrating the configuration of a second antenna according to conventional art.
Figure 1:
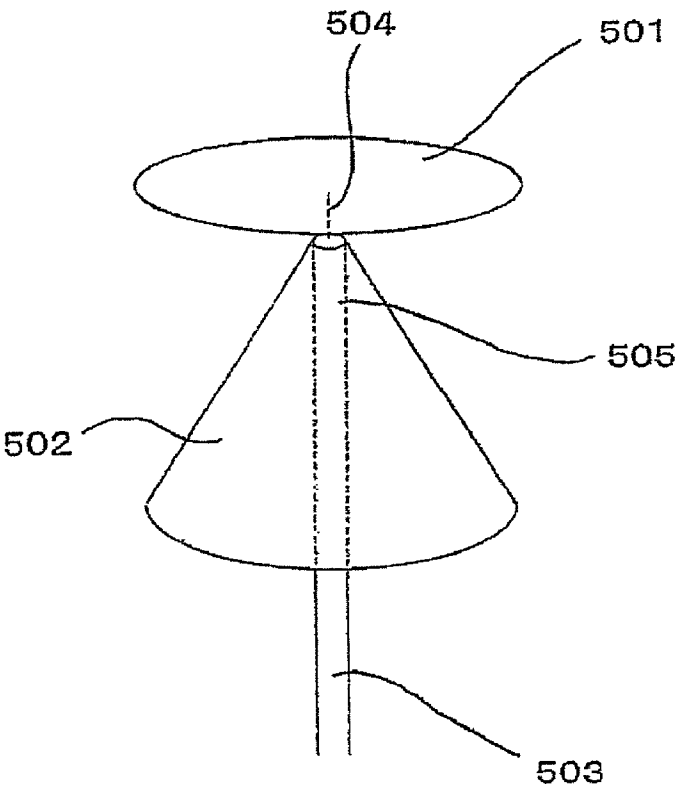
FIG. 1 is a diagram illustrating the configuration of a first antenna according to conventional art.

1, 2: Radiating elements
10: Coaxial cable
11: Coaxial external conductor
12: Coaxial central conductor
13: Soldering
14: Power supply section
15: Power supply conductor
16: Insulator
17: Thread
20, 21: Power supply sections
30, 31: Power supply conductors
40, 41: Insulators
50: Base
51, 52: Radiating elements
53: Thread
54: Hook and loop fastener
60: Power supply unit
61: Hook and loop fastener
62: Printed board
63, 64: Power supply conductors
70: Hook
71: Hook and loop fastener
80: Power supply unit
81: Hook
82: Hook and loop fastener
83: Metal part
85: Thread
86: Printed board
87: Power supply conductor
88: Power supply conductor
89: Metal part
100, 111: Buttons
101: Thread
110: Power supply unit
112, 113: Conductors
114: Printed board
115, 116: Power supply conductors
120, 130: Power supply units
131: Insulator
132: Conductive fabric
133: Hook and loop fastener
134: Printed board
135: Recess
200: Wear
201, 202: Hook and loop fasteners
203: Connector
210, 211: Zip fasteners
220, 221: Buttons
300: Printed circuit boards
301, 302: Radiating elements
303, 311: Microstrip lines
304: Ground
305: Through hole
501: Circular plate
502: Circular cone
503: Coaxial cable
504: Coaxial central conductor
505: Coaxial external conductor
601: Patch element
602: Ground
603: Insulator

BEST MODE FOR CARRYING OUT THE INVENTION

The following describes embodiments of the present invention based on exemplary embodiments.

First Embodiment

(1) Configuration of Wideband Antenna According to First Embodiment

Figure 3:
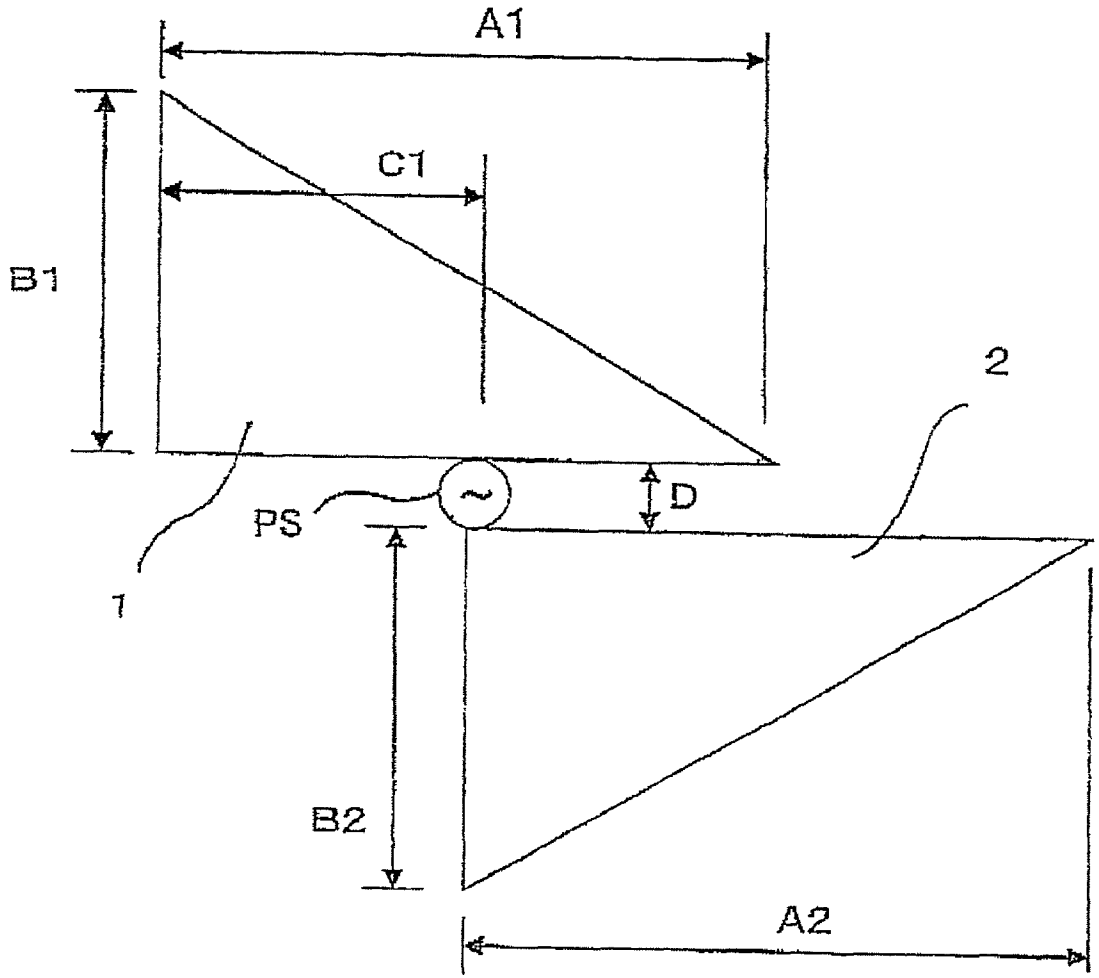
FIG. 3 is a diagram illustrating the configuration of a wideband antenna according to a first embodiment of the present invention.

FIG. 3 is a diagram illustrating the configuration of a wideband antenna according to a first embodiment of the present invention.

The wideband antenna illustrated in FIG. 3 includes a radiating element 1 consisting of a conductive plate in the shape of a right triangle, a radiating element 2 similarly consisting of a conductive plate in the shape of a right triangle, and a power supply section PS.

Moreover, in principle, the radiating elements 1 and 2 used have the same shape and size. However, even if the radiating elements 1 and 2 are somewhat different in shape and size, similar effects can be obtained.

If the elements are different in shape and size, the criterion of the difference in length between the respective sides is relatively less than or equal to ±20%.

Moreover, the right triangle does not necessarily mean that the angle is strictly limited to 90 degrees. The radiating elements 1 and 2 may be made of conductive plates substantially in the shape of a right angle.

In FIG. 3, the length A1 of the lateral side of the radiating element 1 is usually set at about one-quarter of the wavelength of the lowest usable frequency to be used.

One of the two sides, except the hypotenuse, of one radiating element is disposed parallel to that of the other radiating element such that the sides have line symmetry. Then, one of the radiating elements is shifted in a direction parallel to the line of symmetry.

It is usually desirable that the amount of shift C1 be around 0.14 of the wavelength of the lowest usable frequency to be used. However, depending on the matching state, the amount of shift C1 is so set as to be appropriate in the range of 0.1 to 0.2 of the wavelength.

Moreover, it is desirable that the distance D between the radiating elements 1 and 2 is set in the range of 0.001 to 0.03 of the wavelength.

The power supply section PS is between a position which is the amount of shift C1 away from the right end of the lateral side of the radiating element 1 and the apex of the right angle corner of the radiating element 2, for supplying electricity.

To the power supply section PS, the parallel two-wire transmission line or the coaxial cable is connected.

Second Embodiment

(2) Configuration of Wideband Antenna According to Second Embodiment

Figure 4:
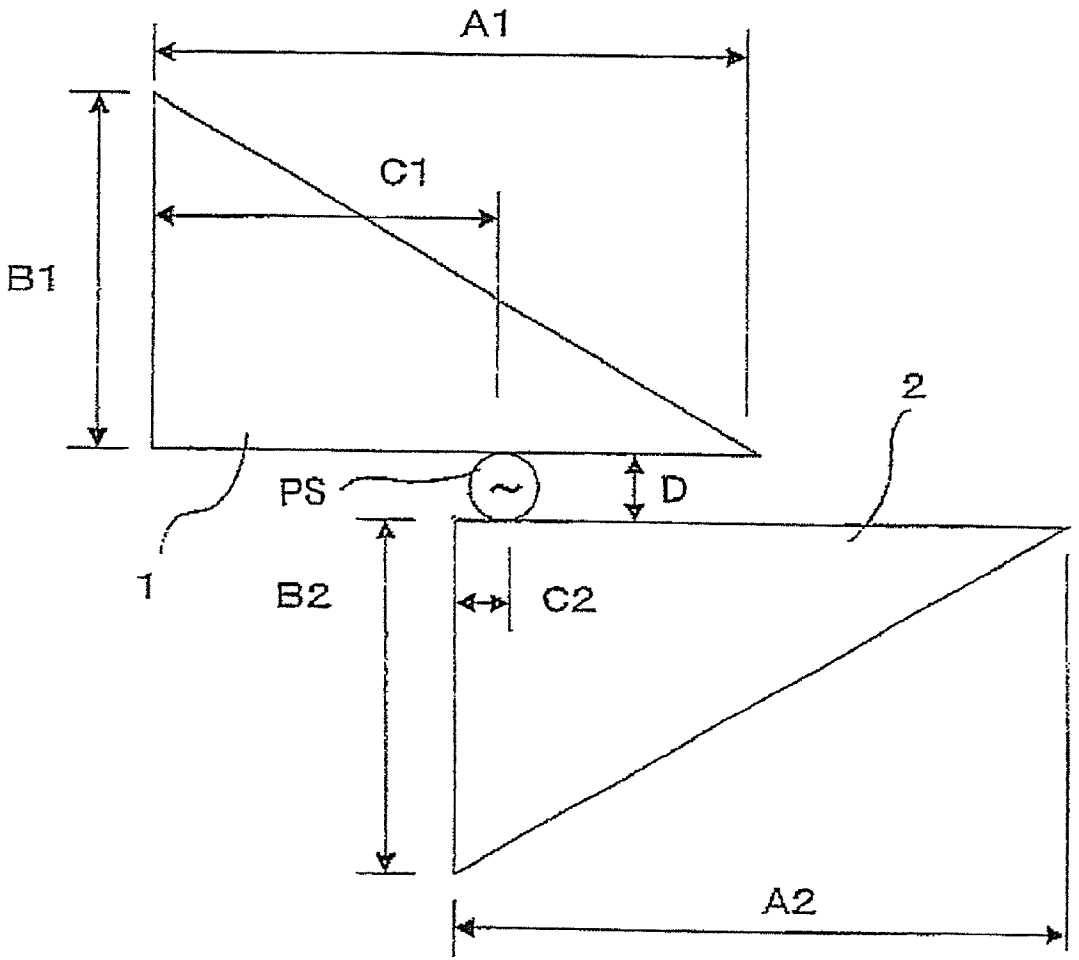
FIG. 4 is a diagram illustrating the configuration of a wideband antenna according to a second embodiment of the present invention.

FIG. 4 is a diagram illustrating the configuration of a wideband antenna according to a second embodiment of the present invention.

Like the one illustrated in FIG. 3, the wideband antenna includes a radiating element 1 consisting of a conductive plate in the shape of a right triangle, a radiating element 2 similarly consisting of a conductive plate in the shape of a right triangle, and a power supply section PS.

The difference between the wideband antenna of FIG. 4 and that of FIG. 3 is that the power supply section PS has been shifted to the right by C2 from the apex of the right angle corner of the radiating element 2.

C2 is usually set at around 0 to 0.1 of the wavelength.

Third Embodiment

(3) Configuration of Wideband Antenna According to Third Embodiment

Figure 5A:
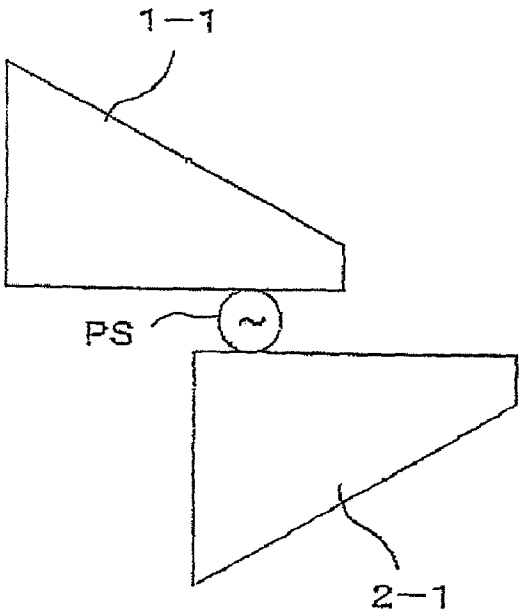
FIGS. 5A to 5C are diagrams illustrating the configurations of wideband antennas according to a third embodiment of the present invention.
Figure 5B:
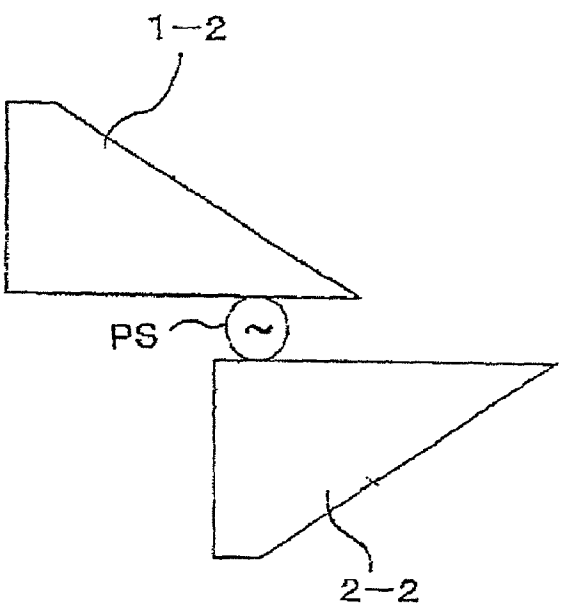
Figure 5C:
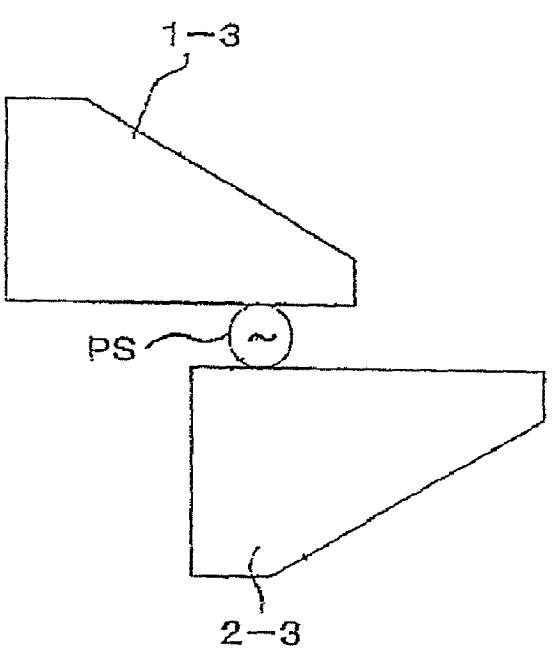

FIGS. 5A to 5C are diagrams illustrating the configurations of wideband antennas according to a third embodiment of the present invention.

In FIGS. 5A to 5C, the corners, except the right angle corner, of the radiating elements have been cut off. In general, the acute portions may be dangerous when the products are handled. Even if the acute apical portions are cut off as illustrated in FIGS. 5A to 5C, a similar level of performance can be achieved.

At this time, the criterion of the length of the cut-off portion is less than or equal to 1/50 of the wavelength.

In FIGS. 5A and 5B, the shape of the radiating elements is a trapezoid. In FIG. 5C, the shape is a pentagon.

Incidentally, the apical portions may have a curved shape, such as a circular arc or a curved line, rather than being cut off.

Fourth Embodiment

(4) Configuration of Wideband Antenna According to Fourth Embodiment

Figure 6:
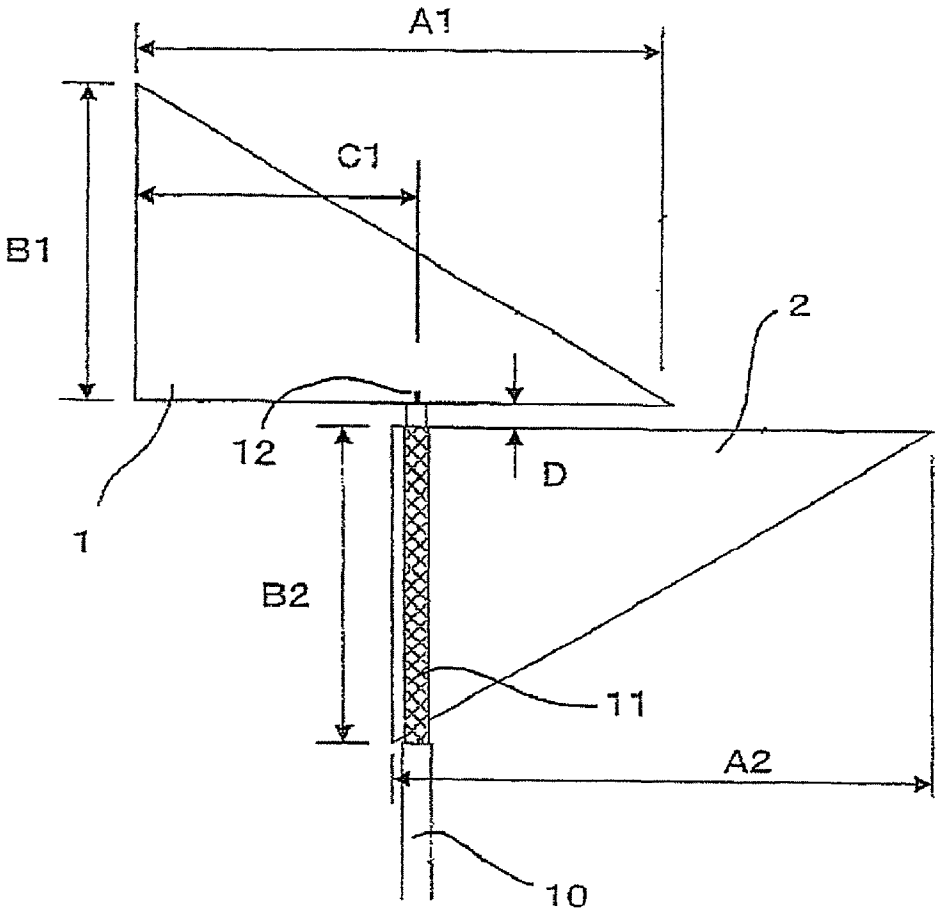
FIG. 6 is a diagram illustrating the configuration of a wideband antenna according to a fourth embodiment of the present invention.

FIG. 6 is a diagram illustrating the configuration of a wideband antenna according to a fourth embodiment of the present invention.

The fourth embodiment illustrated in FIG. 6 is one example in which a coaxial cable is used for the power supply section PS with the configuration of the second embodiment illustrated in FIG. 4.

A coaxial central conductor 12 of a coaxial cable 10 is connected to the radiating element 1, and a coaxial external conductor 11 is connected to the radiating element 2. Incidentally, soldering or the like is used for connection.

Figure 7:
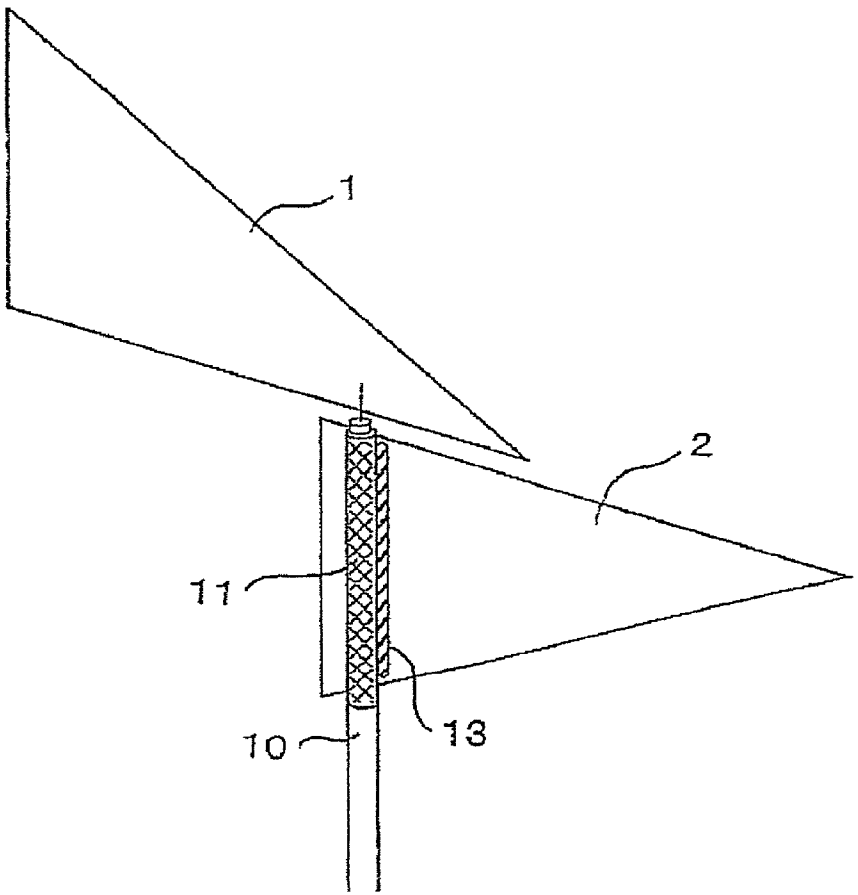
FIG. 7 is a perspective view of the wideband antenna according to the fourth embodiment of the present invention.

FIG. 7 is a perspective view of the fourth embodiment.

As illustrated in FIG. 7, in the wideband antenna of the fourth embodiment, the coaxial external conductor 11 of the coaxial cable 10 is connected to the radiating element 2 with solder 13.

Fifth Embodiment

(5) Configuration of Wideband Antenna According to Fifth Embodiment

Figure 8:
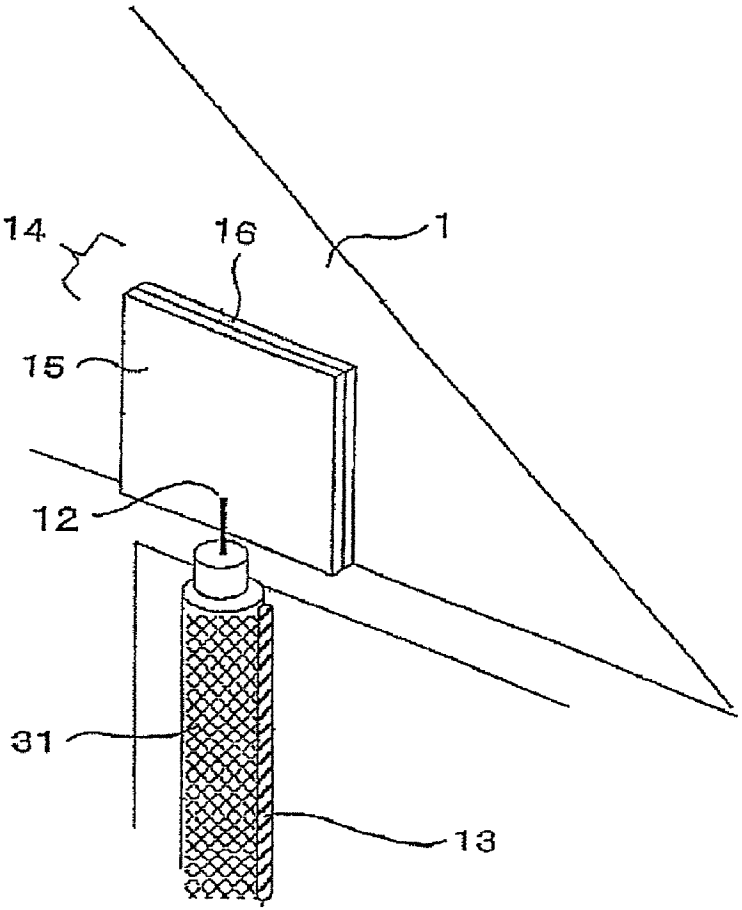
FIG. 8 is a diagram illustrating the configuration of a wideband antenna according to a fifth embodiment of the present invention.

FIG. 8 is a diagram illustrating the configuration of a wideband antenna according to a fifth embodiment of the present invention.

The difference between the wideband antenna of the fifth embodiment illustrated in FIG. 8 and the wideband antenna of the fourth embodiment illustrated in FIGS. 6 and 7 is that a power supply section 14 is used for the power supply section PS of the coaxial central conductor 12.

The power supply section 14 includes a power supply conductor 15, which is a conductor, and an insulator 16. A flexible printed circuit board or a thin printed circuit board is usually used.

The coaxial central conductor 12 is fixed to the power supply conductor 15 with solder.

A sufficiently thin material is used for the insulator 16, and the capacitance between the power supply conductor 15 and the radiating element 1 is raised so that the value becomes sufficiently small reactance with respect to the usable frequency. Therefore, the same effects as in the case of direct connection can be obtained in terms of high frequencies.

Moreover, the thickness of the insulator 16 and the area of the power supply conductor 15 may be changed to adjust the capacitance. Therefore, it is also possible to control impedance matching when electricity is supplied to the radiating element 1.

Moreover, the structure illustrated in FIG. 8 is particularly effective if the radiating elements 1 and 2 consist of conductive fabrics or the like.

The reason is that soldering cannot be used on the conductive fabric. The power supply section 14 may consist of a flexible printed circuit board, and be bonded to the radiating element 1 with an adhesive or an iron-print adhesive.

Sixth Embodiment

(6) Configuration of Wideband Antenna According to Sixth Embodiment

Figure 9:
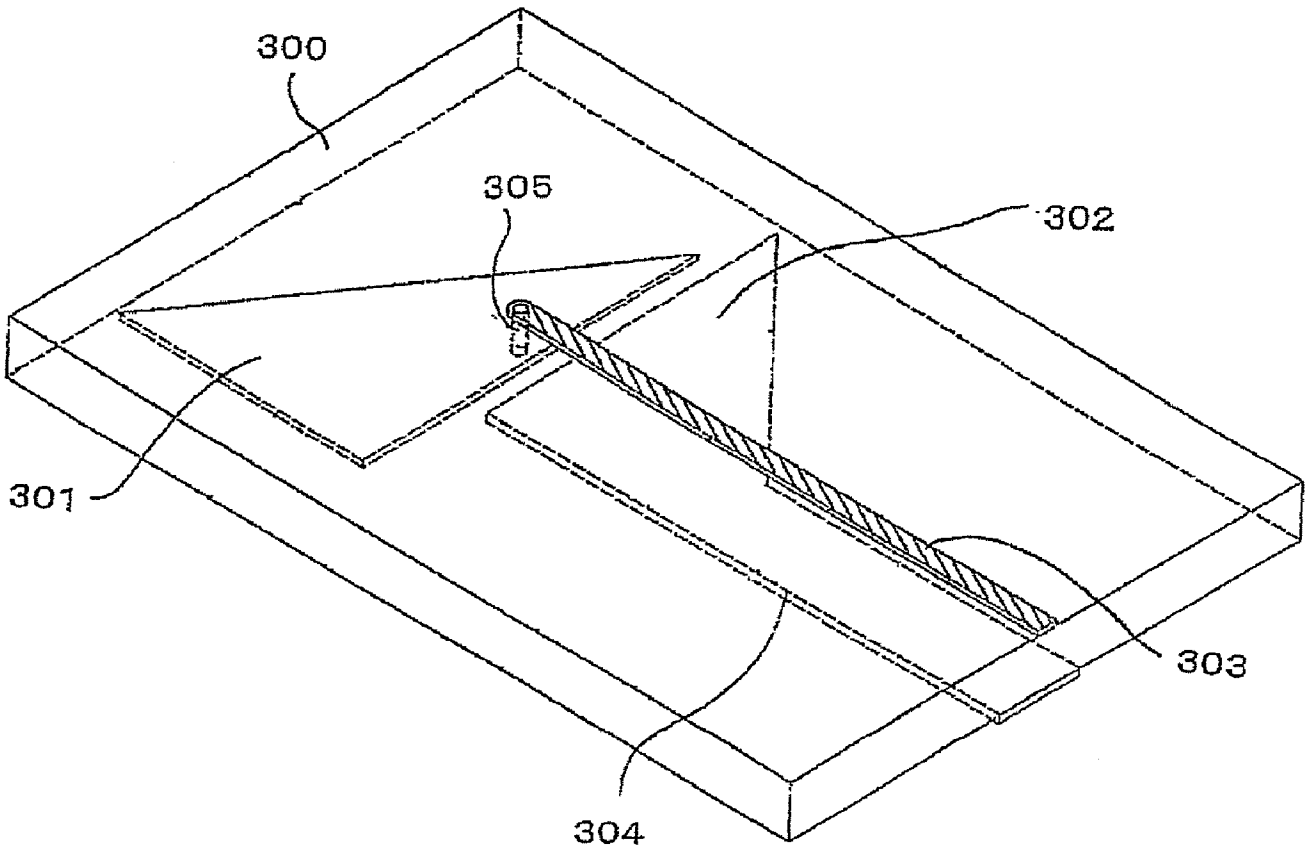
FIG. 9 is a diagram illustrating the configuration of a wideband antenna according to a sixth embodiment of the present invention.

FIG. 9 is a diagram illustrating the configuration of a wideband antenna according to a sixth embodiment of the present invention.

The wideband antenna of the sixth embodiment illustrated in FIG. 9 is formed based on the wideband antenna of the fourth embodiment illustrated in FIG. 6 with the use of a printed circuit board 300.

Such materials as Teflon (Registered Trademark), FR-4 (glass epoxy), BT resin and PPE (polyphenylene ether) are often used for the printed circuit board 300.

On the lower side of the printed circuit board 300, radiating elements 301 and 302, which are similar to those of FIG. 6, are formed by etching as conductive patterns.

Electricity is supplied via a through hole 305 by a microstrip line 303 which is formed on the upper side of the printed circuit board 300. The microstrip line 303 serves as an electric supply line.

A ground 304 forms a microstrip line along with the microstrip line 303.

Seventh Embodiment

(7) Configuration of Wideband Antenna According to Seventh Embodiment

Figure 10:
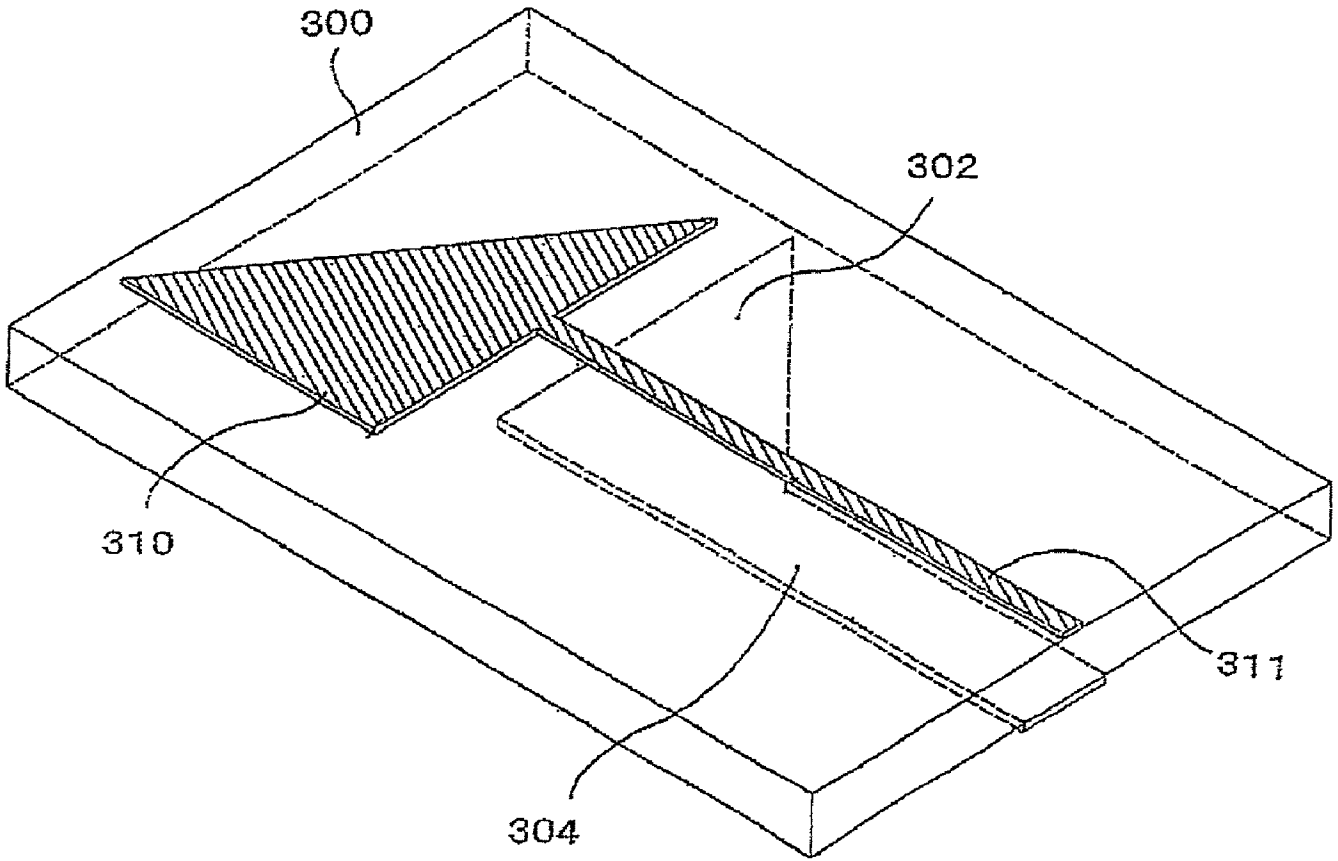
FIG. 10 is a diagram illustrating the configuration of a wideband antenna according to a seventh embodiment of the present invention.

FIG. 10 is a diagram illustrating the configuration of a wideband antenna according to a seventh embodiment of the present invention.

The difference between the wideband antenna of the seventh embodiment illustrated in FIG. 10 and the sixth embodiment illustrated in FIG. 9 is that the radiating element 310 is disposed on the upper side of the printed circuit board 300, directly connected by a microstrip line 311, and supplied with electricity.

The ground 304 forms a microstrip line along with the microstrip line 303.

Eighth Embodiment

(8) Configuration of Wideband Antenna According to Eighth Embodiment

Figure 11:
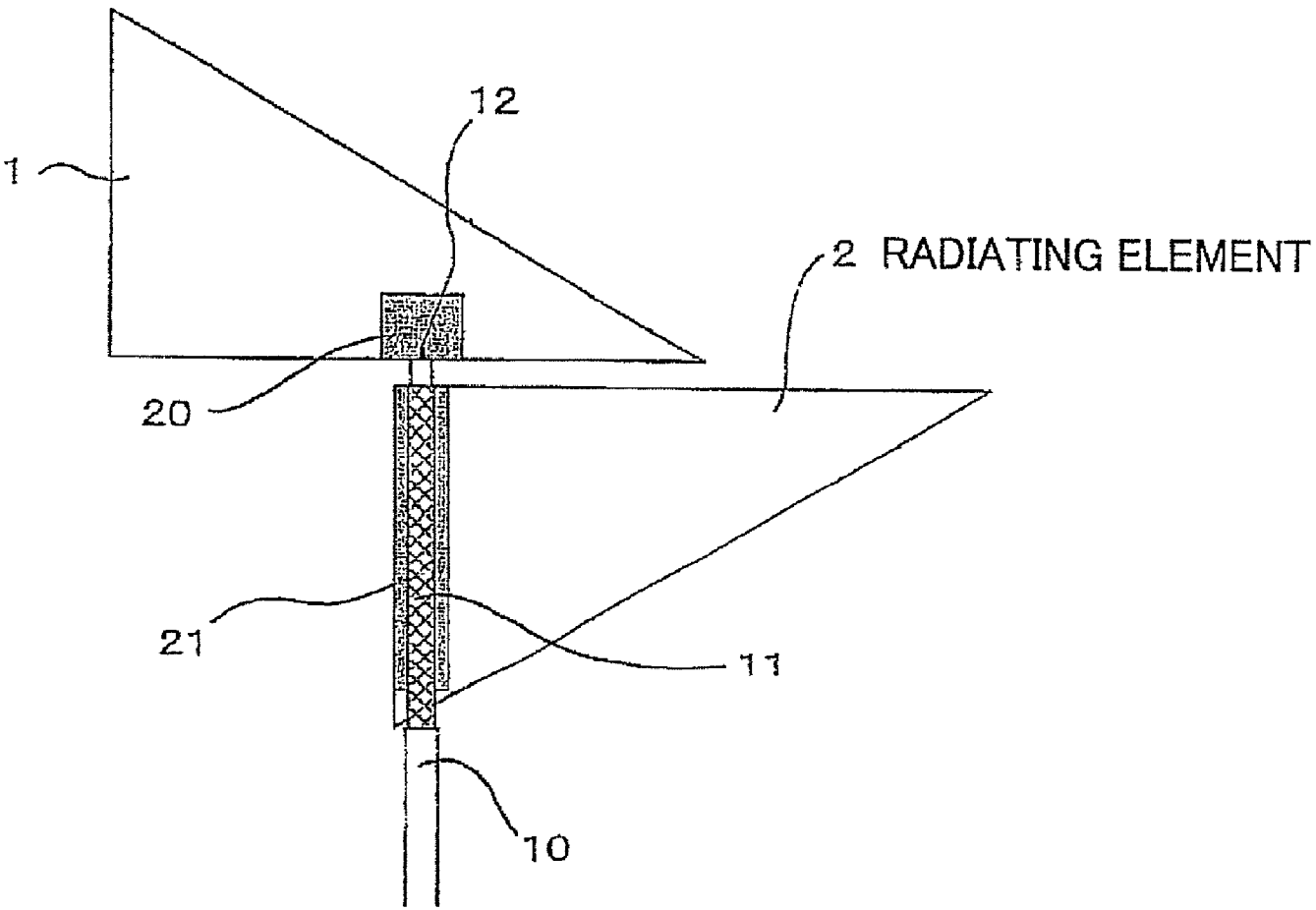
FIG. 11 is a diagram illustrating the configuration of a wideband antenna according to an eighth embodiment of the present invention.

FIG. 11 is a diagram illustrating the configuration of a wideband antenna according to an eighth embodiment of the present invention.

The difference between the wideband antenna of the eighth embodiment illustrated in FIG. 11 and the wideband antenna of the fifth embodiment illustrated in FIG. 8 is that power supply sections 20 and 21 are used to supply electricity to both the coaxial central conductor 12 and the coaxial external conductor 11.

Figure 12:
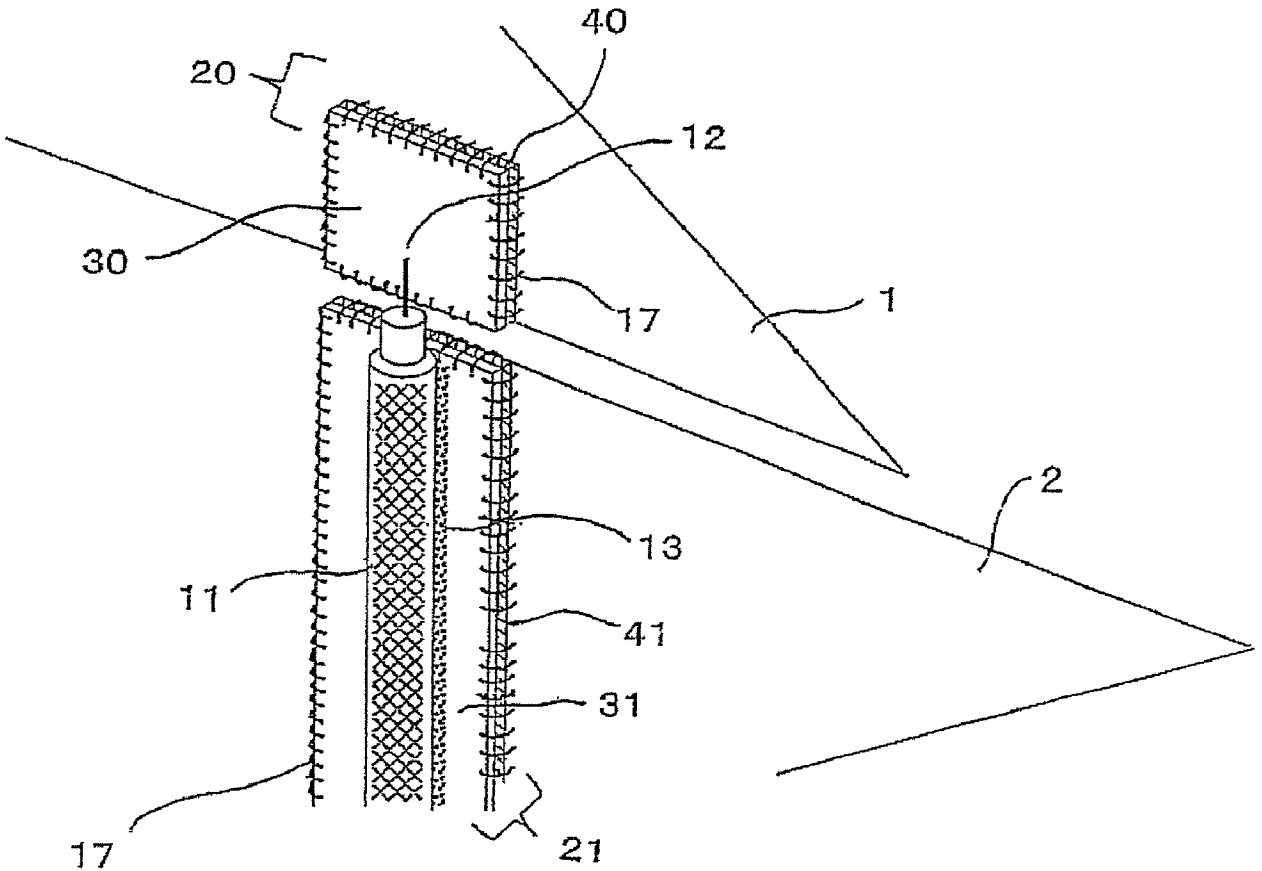
FIG. 12 is a detail view of a power supply unit of the wideband antenna according to the eighth embodiment of the present invention.

FIG. 12 is a detail view of the eighth embodiment.

As illustrated in FIG. 12, in the wideband antenna of the eighth embodiment, the power supply section 20 is formed by a power supply conductor 30 and an insulator 40.

In general, the power supply section 20 is formed by a flexible printed circuit board or a thin printed circuit board as a unit.

Similarly, the power supply section 21 is formed by a power supply conductor 31 and an insulator 41.

Like the power supply section 20, the power supply section 21 is formed by a flexible printed circuit board or a thin printed circuit board as a unit.

The power supply sections 20 and 21 are respectively sewed and fixed on the radiating elements 1 and 2 with thread 17.

The coaxial central conductor 12 is fixed on the power supply conductor 30 with solder, and the coaxial external conductor 11 is fixed on the power supply conductor 31 with solder.

Like the case of FIG. 8, the power supply conductors 30 and 31 have capacitance between the radiating elements 1 and 2. According to a principle similar to the explanation of FIG. 8, the connection of the radiating elements 1 and 2 or impedance adjustment can be realized.

The configuration of FIGS. 9 and 10 is effective when the radiating elements 1 and 2 are formed by a conductive fabric or the like.

The power supply sections 20 and 21 are formed by a flexible printed circuit board and sewed with the thread 17. Therefore, the advantage is that the power supply sections 20 and 21 fit well with cloth, appear to be natural even when being attached to clothing, and are not easily broken.

Incidentally, the thread used here may be conductive thread or thin wires instead of the usual non-conductive fiber thread.

Ninth Embodiment

(9) Configuration of Wideband Antenna According to Ninth Embodiment

Figure 13:
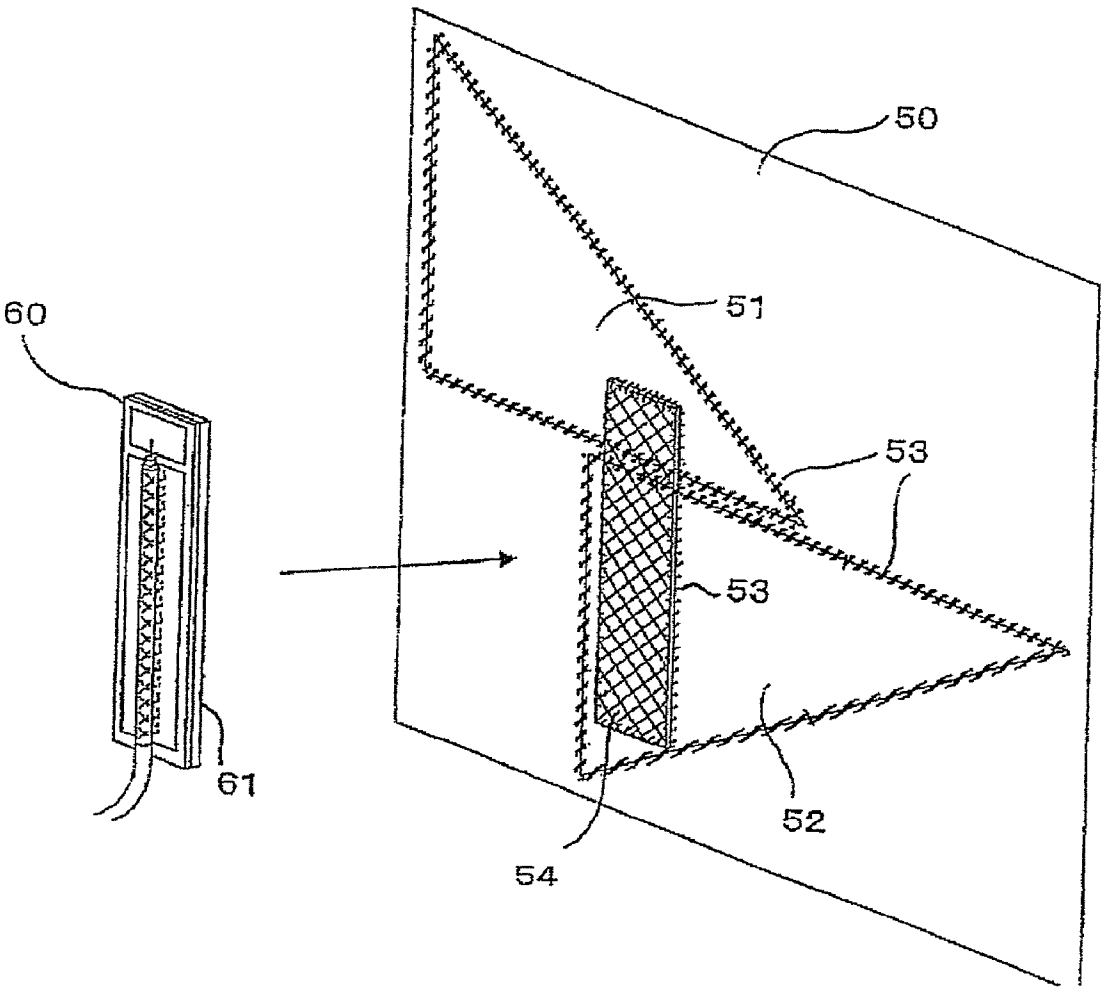
FIG. 13 is a diagram illustrating the configuration of a wideband antenna according to a ninth embodiment of the present invention.

FIG. 13 is a diagram illustrating the configuration of a wideband antenna according to a ninth embodiment of the present invention.

In the wideband antenna of the ninth embodiment illustrated in FIG. 13, a base 50 is made of a flexible material, such as fabrics, that can be bent.

In the wideband antenna of the ninth embodiment, radiating elements 51 and 52 consisting of a conductive fabric, a flexible printed circuit board which can be bent, or the like are sewed on the base 50 with thread 53.

Moreover, a hook and loop fastener (Registered Trademark) 54 is sewed around a position where the radiating elements 51 and 52 might be originally supplied with electricity, with the thread 53.

In this case, instead of the thread 53, the radiating elements 51 and 52 and the hook and loop fastener 54 may be bonded with an adhesive or an iron-print adhesive as described above with reference to FIG. 8.

A power supply unit 60 is attached to the hook and loop fastener 54 to supply electricity.

Figure 14:
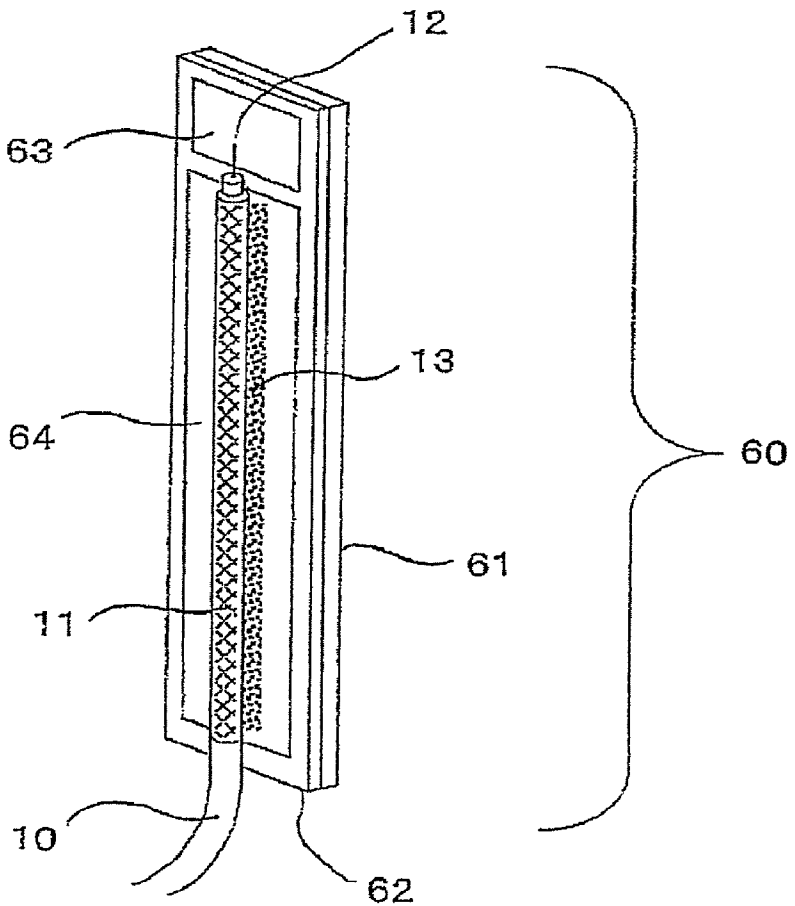
FIG. 14 is a detail view of a power supply unit of the wideband antenna according to the ninth embodiment of the present invention.

FIG. 14 is a detail view of the power supply unit 60 of the ninth embodiment illustrated in FIG. 13.

The power supply unit 60 illustrated in FIG. 14 is equipped with a hook and loop fastener 61 and a printed board 62.

As illustrated in FIG. 13, the hook and loop fastener 61 is used to connect the power supply unit 60 to the hook and loop fastener 54 on the side of the radiating element.

The printed board 62 is formed by a flexible printed circuit board that can be bent, a thin printed circuit board, or the like, and is equipped with power supply conductors 63 and 64 as conductive patterns on the surface.

Moreover, the coaxial central conductor 12 of the coaxial cable 10 is fixed on the power supply conductor 63 with solder, and the coaxial external conductor 11 is fixed on the power supply conductor 64 with solder.

According to the ninth embodiment illustrated in FIGS. 13 and 14, the power supply unit 60 is attached. Therefore, the power supply conductors 63 and 64 illustrated in FIG. 14 have capacitance with respect to the radiating elements 51 (FIG. 13) and 52 (FIG. 13), respectively. As a result, electricity is supplied according to the principle explained by using FIG. 8.

Tenth Embodiment

(10) Configuration of Wideband Antenna According to Tenth Embodiment

Figure 15:
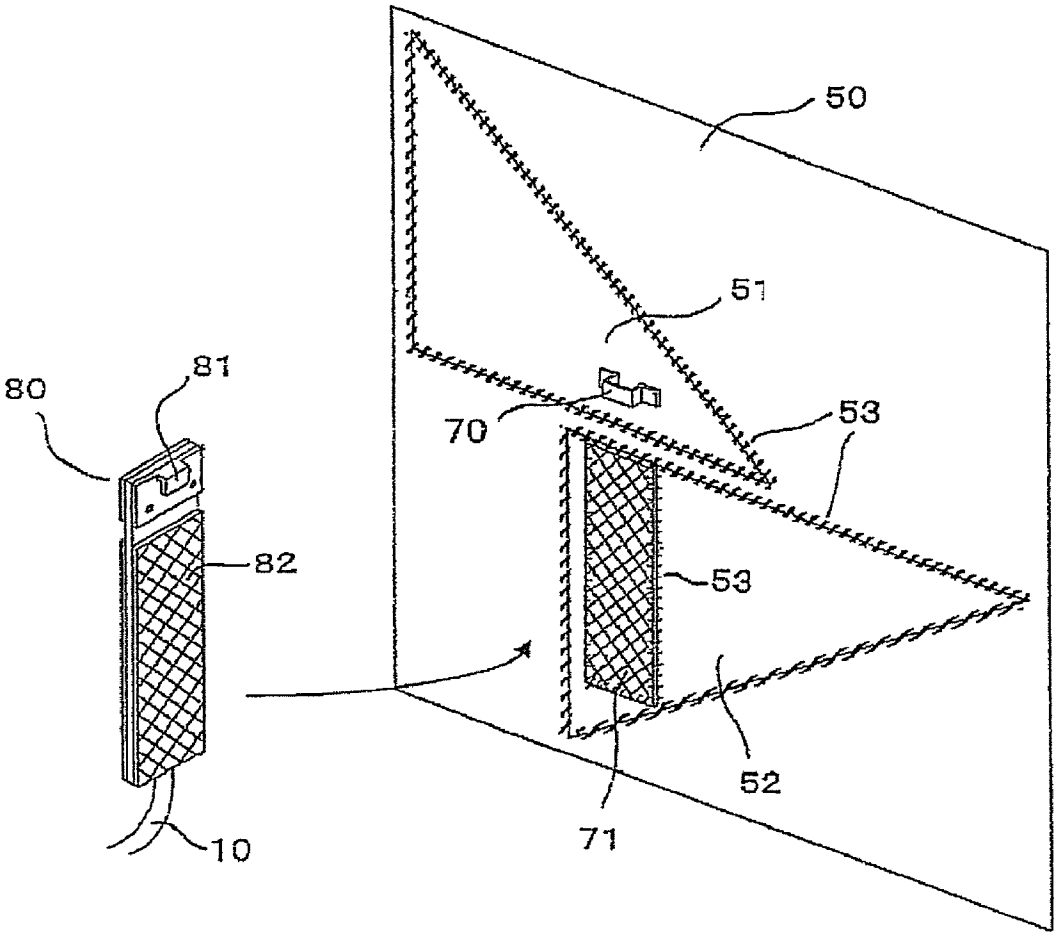
FIG. 15 is a diagram illustrating the configuration of a wideband antenna according to a tenth embodiment of the present invention.

FIG. 15 is a diagram illustrating the configuration of a wideband antenna according to a tenth embodiment of the present invention.

In the wideband antenna of the tenth embodiment illustrated in FIG. 15, like the one illustrated in FIG. 13, the base 50 is made of a flexible material, such as fabrics, that can be bent, and the radiating elements 51 and 52 are sewed on the base 50 with the thread 53.

Moreover, a hook 70 is sewed at a position where the radiating element 51 might be originally supplied with electricity, with thread.

Moreover, a hook and loop fastener 71 is sewed around a position where the radiating element 52 might be originally supplied with electricity with the thread 53.

In this case, as described above, the hook and loop fastener 71 may be fixed with an adhesive or the like instead of the thread 53.

On the other hand, a power supply unit 80 has a hook 81 and a hook and loop fastener 82, which are to be attached to the hook 70 and hook and loop fastener 71, respectively. Therefore, the power supply unit 80 adheres closely to the base 50 and supplies electricity to the radiating elements 51 and 52.

Figures 16A, 16B:
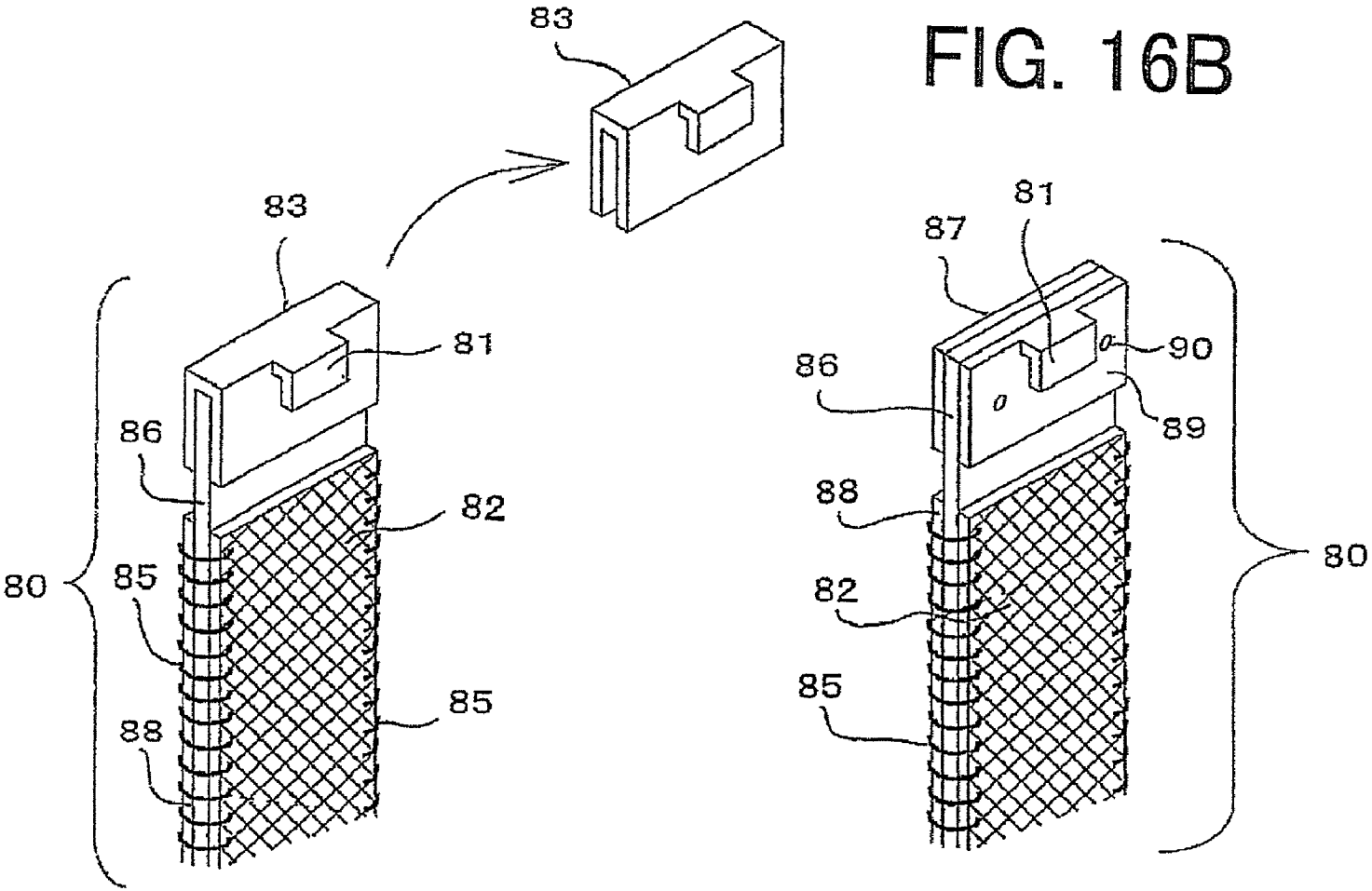
FIGS. 16A and 16B are detail views of a power supply unit of the wideband antenna according to the tenth embodiment of the present invention.

FIGS. 16A and 16B are detail views of the power supply unit 80 illustrated in FIG. 15.

Here, there are considered to be two embodiments shown FIGS. 16A and 16B in the power supply unit 80.

In the embodiment of FIG. 16A, the power supply unit 80 is equipped with a conductive metal part 83, a printed board 86, and a hook and loop fastener 82.

Moreover, a hook 81 is molded on the metal part 83 as a single unit.

Furthermore, the metal part 83 is so fixed as to pinch the tip end section of the printed board 86 equipped with a thin dielectric material.

In this case, adhesives, screws, or eyelets is also effective in fixing the metal part 83.

The hook and loop fastener 82 is attached to the lower side of the printed board 86.

In this case, it is possible to fix the hook and loop fastener 82 by using thread 85, adhesives, or the like in other various ways.

If the printed board 86 is a thin board like a flexible printed circuit board, the thread 85 is effective.

On the back surface of the printed board 86, a power supply conductor 88 is formed by etching as a conductive pattern.

Like the one illustrated in FIG. 14, the coaxial central conductor 12 and the coaxial external conductor 11 of the coaxial cable 10 are fixed on the back surface of the metal part 83 and the power supply conductor 88 with solder, respectively, and electricity is supplied by the power supply unit 80.

The difference between the embodiment of FIG. 16B and the embodiment of FIG. 16A is that the metal part 83 is divided into a metal part 89 and a power supply conductor 87.

In this case, the hook 81 is molded on the metal part 89 as a single unit.

Moreover, the power supply conductor 87 is so fixed by a screw 90 as to pinch the printed board 86.

Instead of the screw 90 and a screw, adhesives, eyelets, a stapler, or the like may be used for fixing.

Then, in a similar way to the one described above with reference to FIG. 16A, the coaxial central conductor 12 and the coaxial external conductor 11 of the coaxial cable 10 are fixed on the power supply conductor 87 and the power supply conductor 88 with solder, allowing the power supply unit 80 to supply electricity.

In the wideband antenna of the tenth embodiment illustrated in FIGS. 15 and 16, the radiating element 52 and the power supply conductor 88 have capacitance at a portion where the hook and loop fastener 71 is attached to 82. Therefore, the radiating element 52 and the power supply conductor 88 are connected to each other in terms of high frequencies. The radiating element 51 is supplied with electricity because the hooks 70 and 81 are electrically connected to each other.

Eleventh Embodiment

(11) Configuration of Wideband Antenna According to Eleventh Embodiment

Figure 17:
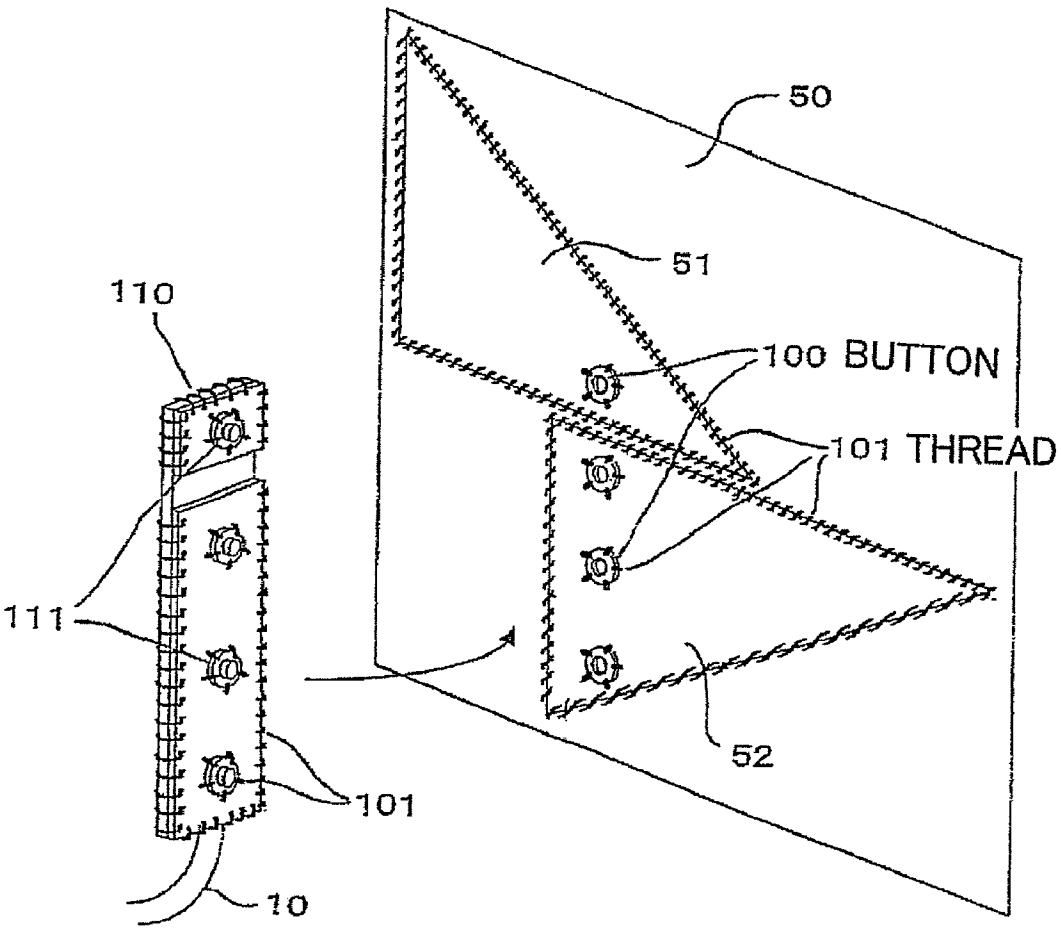
FIG. 17 is a diagram illustrating the configuration of a wideband antenna according to an eleventh embodiment of the present invention.

FIG. 17 is a diagram illustrating the configuration of a wideband antenna according to an eleventh embodiment of the present invention.

The difference between the wideband antenna of the eleventh embodiment illustrated in FIG. 17 and the wideband antenna of the tenth embodiment illustrated in FIGS. 15 and 16 is that a connection method of a power supply unit 110 uses conductive buttons.

That is, the connection of the power supply unit 110 is achieved by fastening conductive buttons 111 sewed on the power supply unit 110 with thread 101 and conductive buttons 100 sewed on the radiating elements 51 and 52 with thread 101.

Figure 18B:
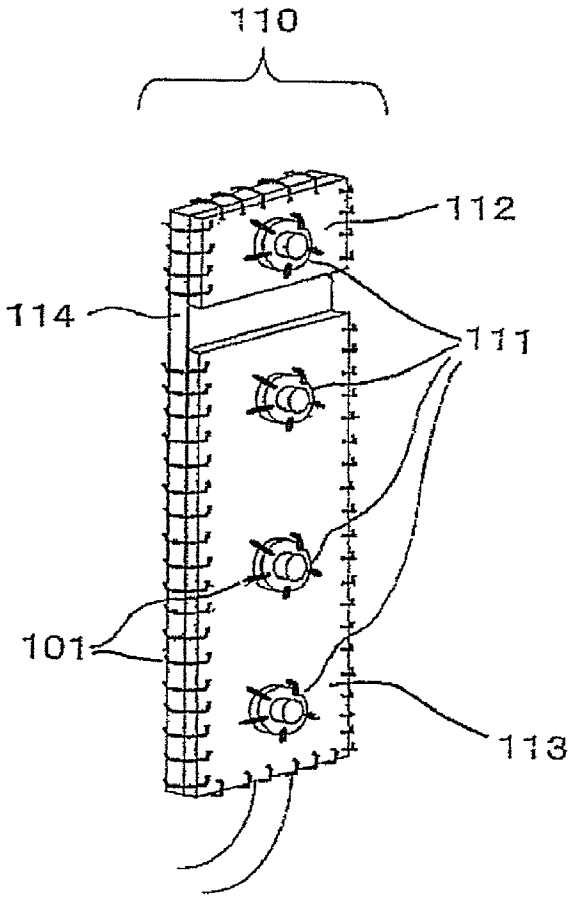
FIGS. 18A and 18B are detail views of a power supply unit of the wideband antenna according to the eleventh embodiment of the present invention.
Figure 18A:
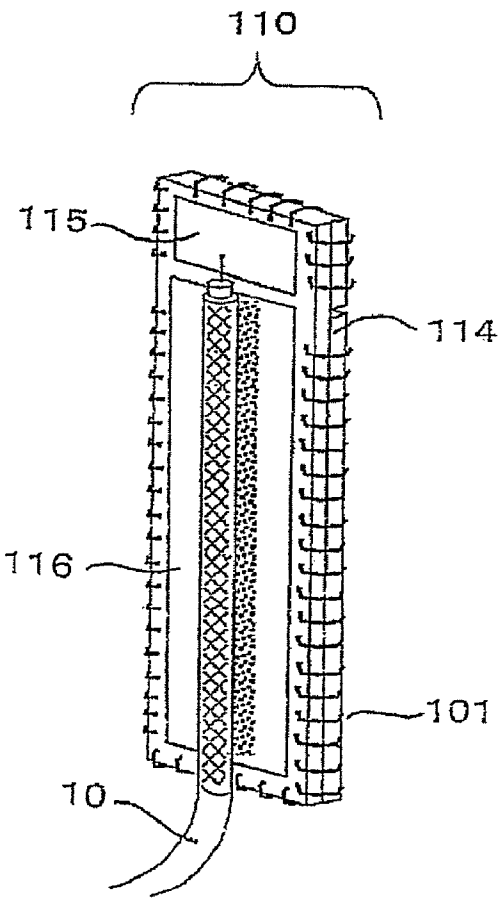

FIGS. 18A and 18B are detail views of the power supply unit 110.

FIG. 18A illustrates the top surface of the power supply unit 110, and FIG. 18B illustrates the back surface.

The power supply unit 110 includes a printed board 114, which is formed by a flexible printed circuit board or a thin printed circuit board, and conductors 112 and 113 sewed on the printed board 114 with the thread 101.

The conductors 112 and 113 are formed by a conductive fabric. The buttons 111 are sewed on the back sides of the conductors 112 and 113 with the thread 101.

On the top surface of the printed board 114, power supply conductors 115 and 116 are formed as conductive patterns by etching at the same positions and in the same shape as the conductors 112 and 113.

Like the one illustrated in FIG. 14, the coaxial cable 10 is fixed on the power supply conductors 115 and 116 with solder.

In the power supply unit 110, the power supply conductors 115 and 116 have capacitance with respect to the conductors 112 and 113, respectively. Therefore, the power supply conductors 115 and 116 are connected to the conductors 112 and 113 in terms of high frequencies, respectively. The conductors 112 and 113 are electrically connected to the radiating elements 51 and 52 via the conductive buttons 111 and 100. Therefore, electricity is supplied.

Twelfth Embodiment

(12) Configuration of Wideband Antenna According to Twelfth Embodiment

Figure 19:
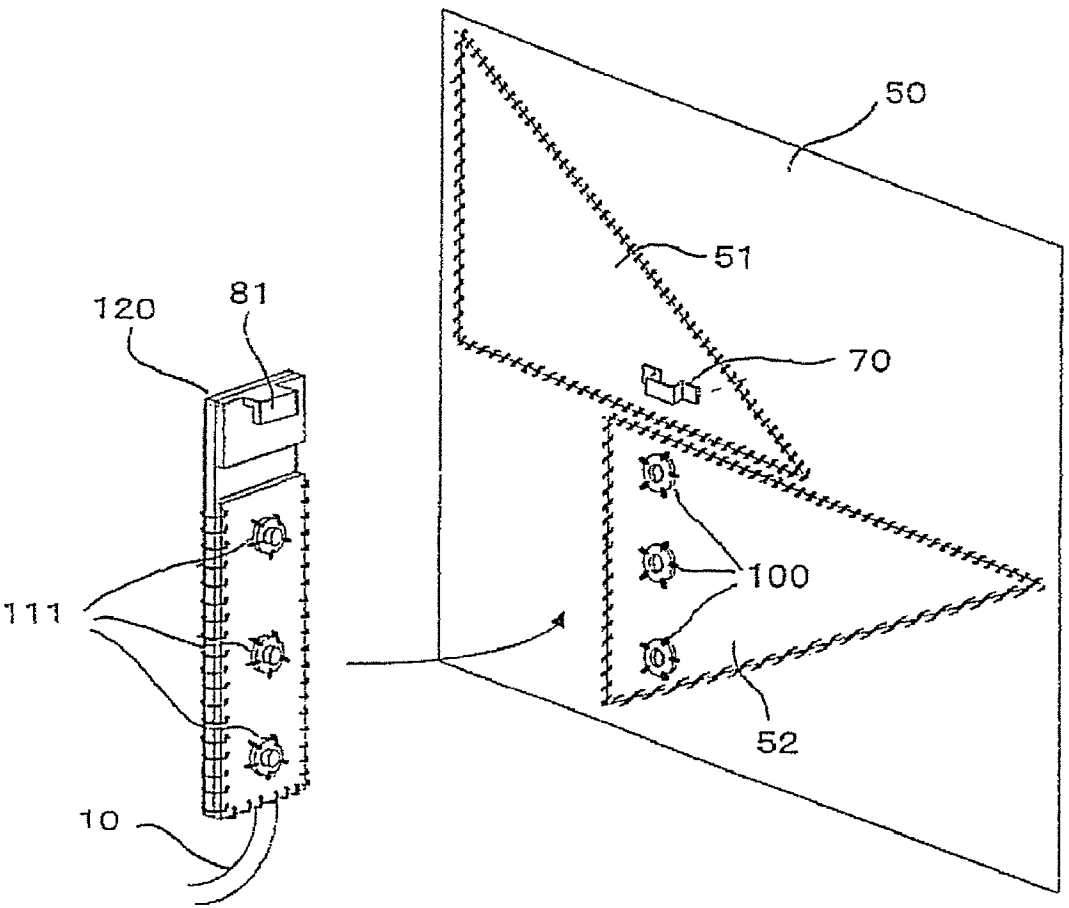
FIG. 19 is a diagram illustrating the configuration of a wideband antenna according to a twelfth embodiment of the present invention.

FIG. 19 is a diagram illustrating the configuration of a wideband antenna according to a twelfth embodiment of the present invention.

The difference between the wideband antenna of the twelfth embodiment illustrated in FIG. 19 and the wideband antenna of the eleventh embodiment illustrated in FIGS. 17 and 18 is that a power supply unit 120 and the radiating element 51 are connected by conductive hooks 70 and 81.

Figure 20B:
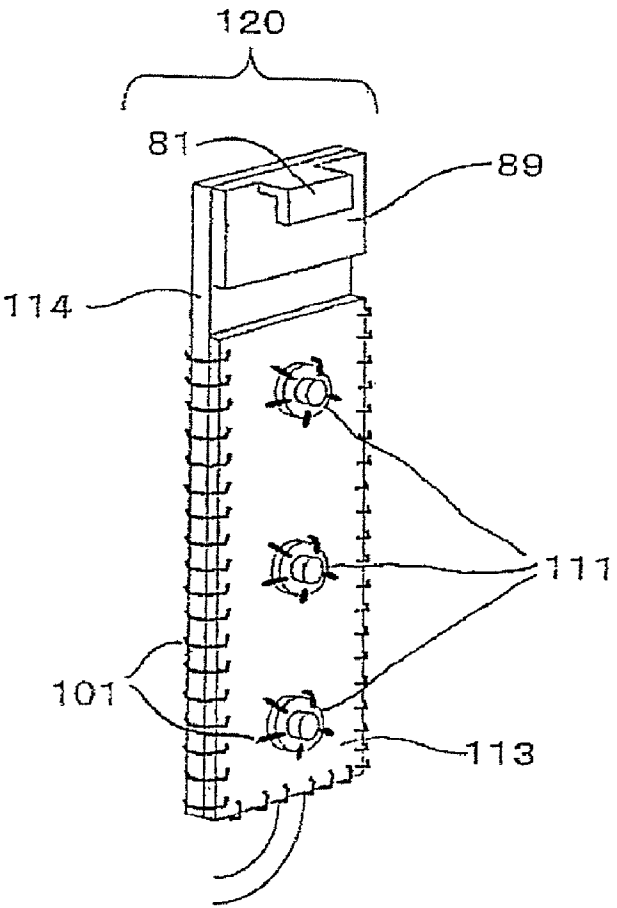
FIGS. 20A and 20B are detail views of a power supply unit of the wideband antenna according to the twelfth embodiment of the present invention.
Figure 20A:
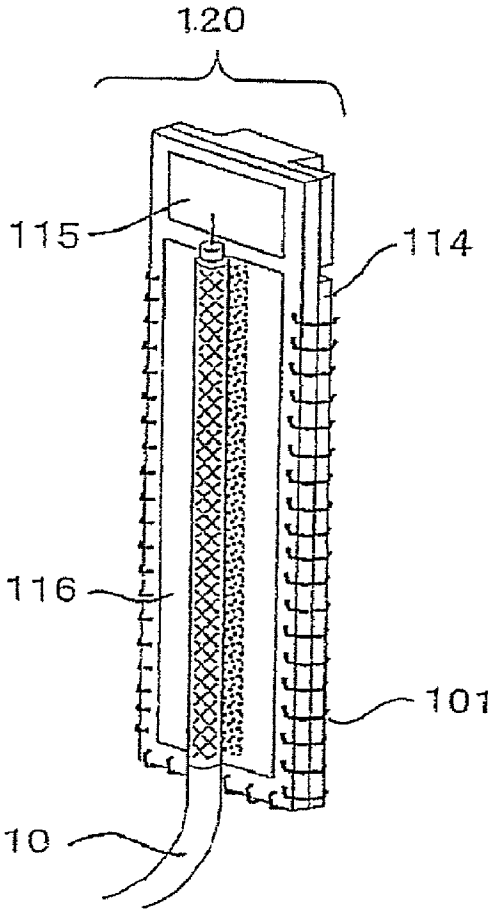

FIGS. 20A and 20B are detail views of the power supply unit 120.

FIG. 20A illustrates the top surface of the power supply unit 120, and FIG. 20B illustrates the back surface.

The power supply unit 120 includes a printed board 114 formed by a flexible printed circuit board or a thin printed circuit board, a metal part 89 including a conductive hook 81, and a conductor 113 made of a conductive fabric.

The metal part 81 can be fixed on the printed board 114 by adhesives, screws, screws, eyelets, staplers or the like.

Moreover, the conductor 113 is fixed in the same way as described above with reference to FIG. 18B. The coaxial cable 10 is connected to the surface of FIG. 20A in the same way as that of FIG. 18A.

Thirteenth Embodiment

Figure 21:
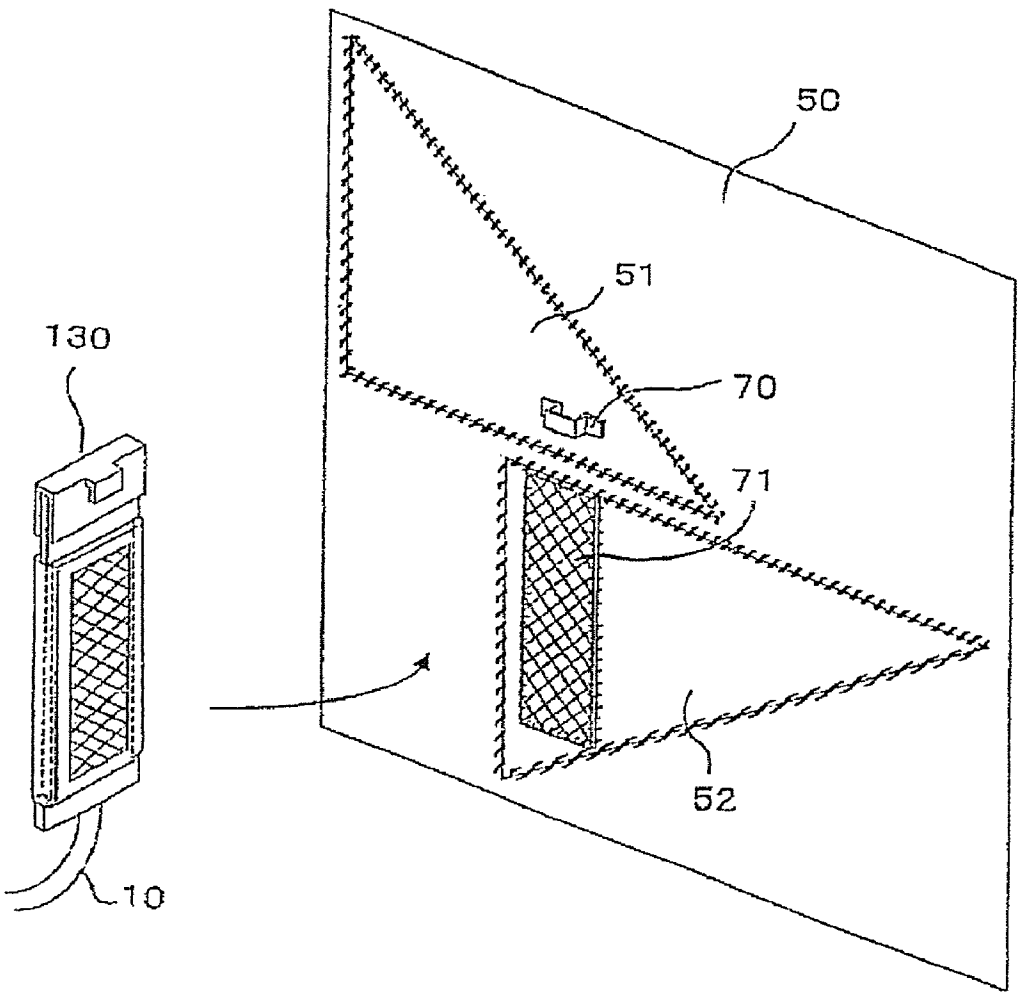
FIG. 21 is a diagram illustrating the configuration of a wideband antenna according to a thirteenth embodiment of the present invention.

FIG. 21 is a diagram illustrating the configuration of a wideband antenna according to a thirteenth embodiment of the present invention.

According to the thirteenth embodiment illustrated in FIG. 21, the base 50 and the components thereon are the same as those of the tenth embodiment illustrated in FIG. 15. Moreover, a power supply unit 130 is connected in the same way as in the tenth embodiment that the power supply unit 130 is connected by the hooks and the hook and loop fasteners.

The difference between the configuration illustrated in FIG. 21 and the configuration illustrated in FIG. 15 is the configuration of the power supply unit 130.

Figure 22A:
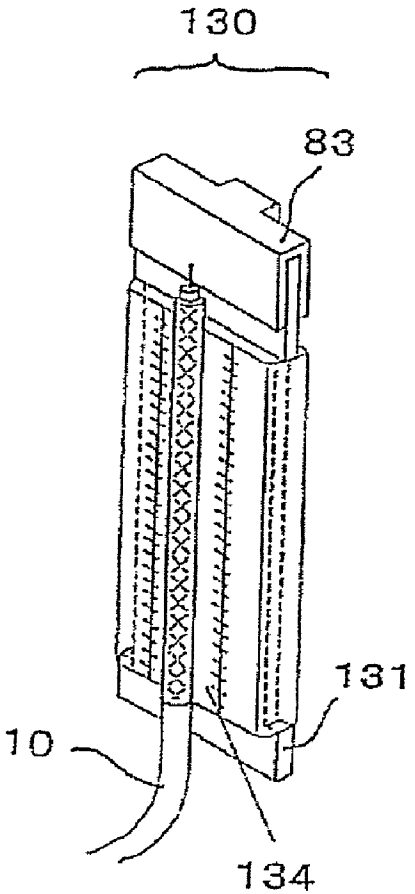
FIGS. 22A to 22C are detail views of a power supply unit of the wideband antenna according to the thirteenth embodiment of the present invention.
Figure 22B:
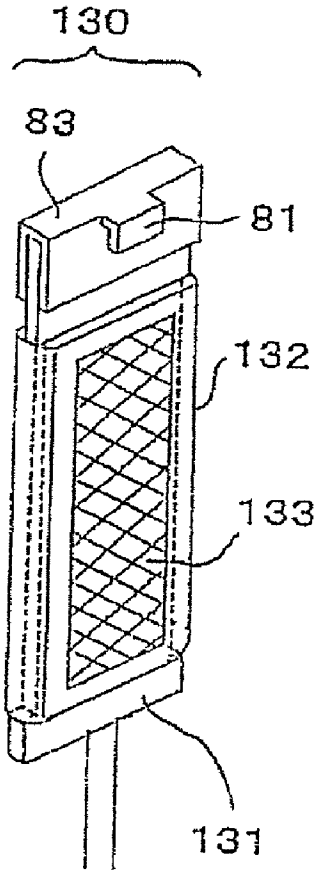

FIGS. 22A and 22B are detail views of the power supply unit 130.

Figure 22C:
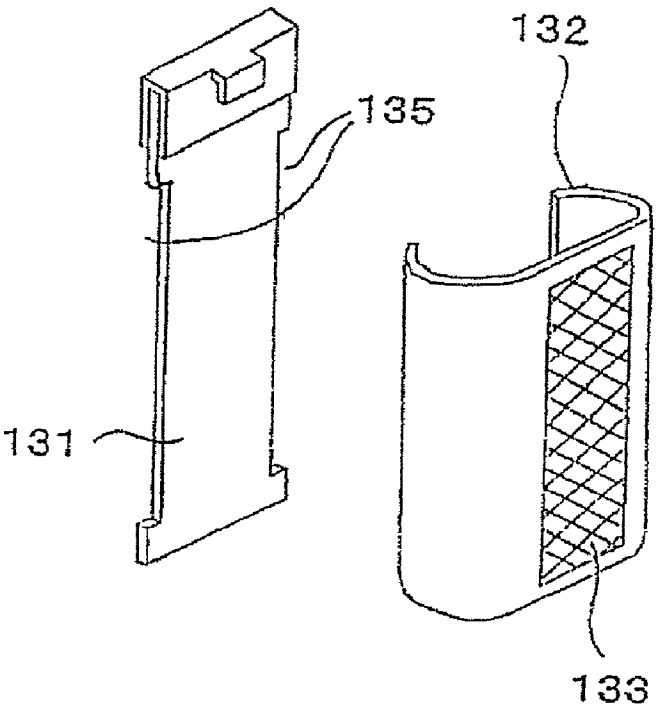

FIG. 22A illustrates the top surface of the power supply unit 130, FIG. 22B illustrates the back surface, and FIG. 22C is an assembly diagram.

In the power supply unit 130, the metal part 83 is fixed on the tip end section of an insulator 131. A conductive fabric 132 which is equipped with a hook and loop fastener 133 is wound around the lower side of insulator 131 and is fixed by sewing.

As illustrated in FIG. 22A which illustrates the top surface, on the top surface of the power supply unit 130, a thin printed board 134, like a flexible printed circuit board, is sewed together and fixed.

Moreover, a conductive pattern section of the printed board 134 is covered with the conductive fabric 132 and fixed by sewing. There is an electrical connection between the conductive pattern section and the conductive fabric 132.

Incidentally, the insulator 131 is equipped with recesses 135 to prevent the conductive fabric 132 from easily dropping off when the conductive fabric 132 is wound around the insulator 131.

In FIGS. 21 and 22, the supply of electricity for the radiating element 51 is done with the hooks 70 and 81 which are electrically connected to each other.

Moreover, the radiating element 52 has capacitance with respect to the conductive fabric 132 and is therefore connected in terms of high frequencies. Therefore, electricity is supplied.

Fourteenth Embodiment

(14) Configuration of Wideband Antenna According to Fourteenth Embodiment

Figure 23:
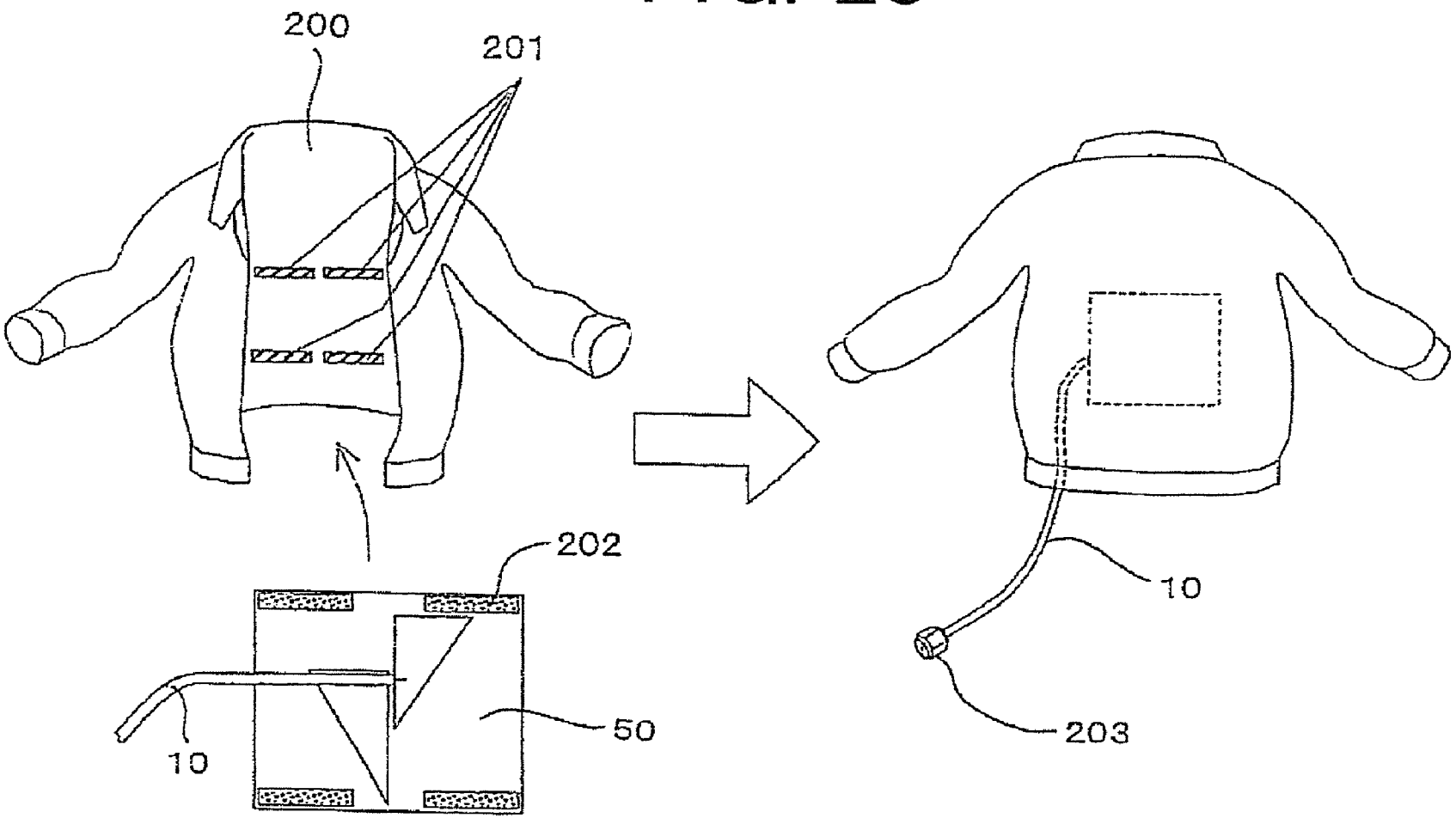
FIG. 23 is a diagram illustrating the configuration of a wideband antenna according to a fourteenth embodiment of the present invention.

FIG. 23 is a diagram illustrating a wideband antenna according to a fourteenth embodiment of the present invention.

The wideband antenna of the fourteenth embodiment illustrated in FIG. 23 is attached to wear 200 with the use of a hook and loop fastener 201.

The base 50 on which the wideband antenna is mounted is equipped with a hook and loop fastener 202, which is attached to the hook and loop fastener 201 of the wear 200.

Therefore, the wideband antenna can be readily removed.

Moreover, a connector 203 is connected to the tip of the coaxial cable 10. Therefore, the wideband antenna is connected to a necessary device.

Fifteenth Embodiment

(15) Configuration of Wideband Antenna According to Fifteenth Embodiment

Figure 24:
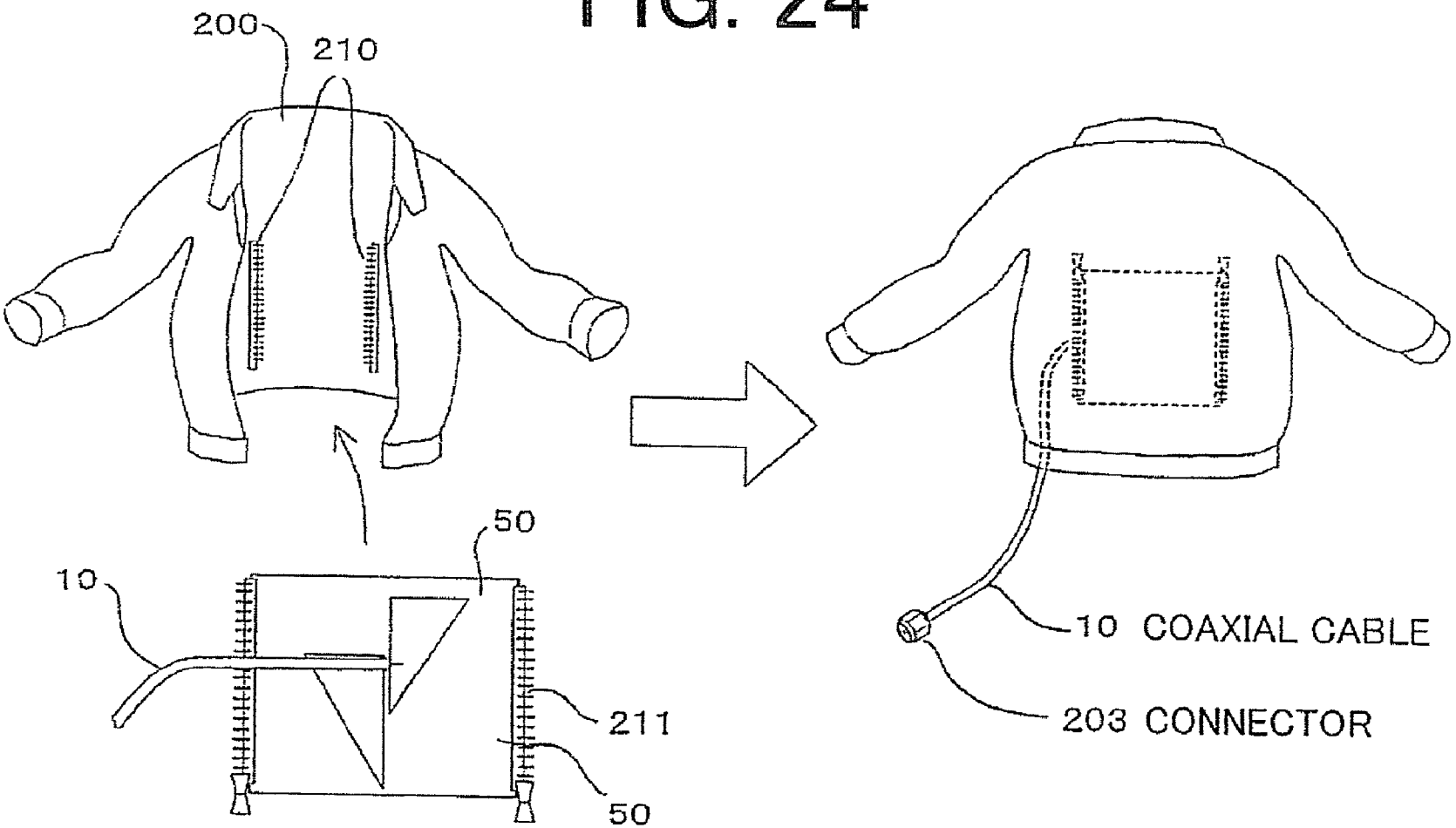
FIG. 24 is a diagram illustrating the configuration of a wideband antenna according to a fifteenth embodiment of the present invention.

FIG. 24 is a diagram illustrating the configuration of a wideband antenna according to a fifteenth embodiment of the present invention.

The difference between the configuration illustrated in FIG. 24 and the configuration illustrated in FIG. 23 is that zip fasteners 210 are added to the wear 200 so that the wideband antenna is attached to the wear 200 through the zip fasteners 210 and zip fasteners 211 of the base 50.

Sixteenth Embodiment

(16) Configuration of Wideband Antenna According to Sixteenth Embodiment

Figure 25:
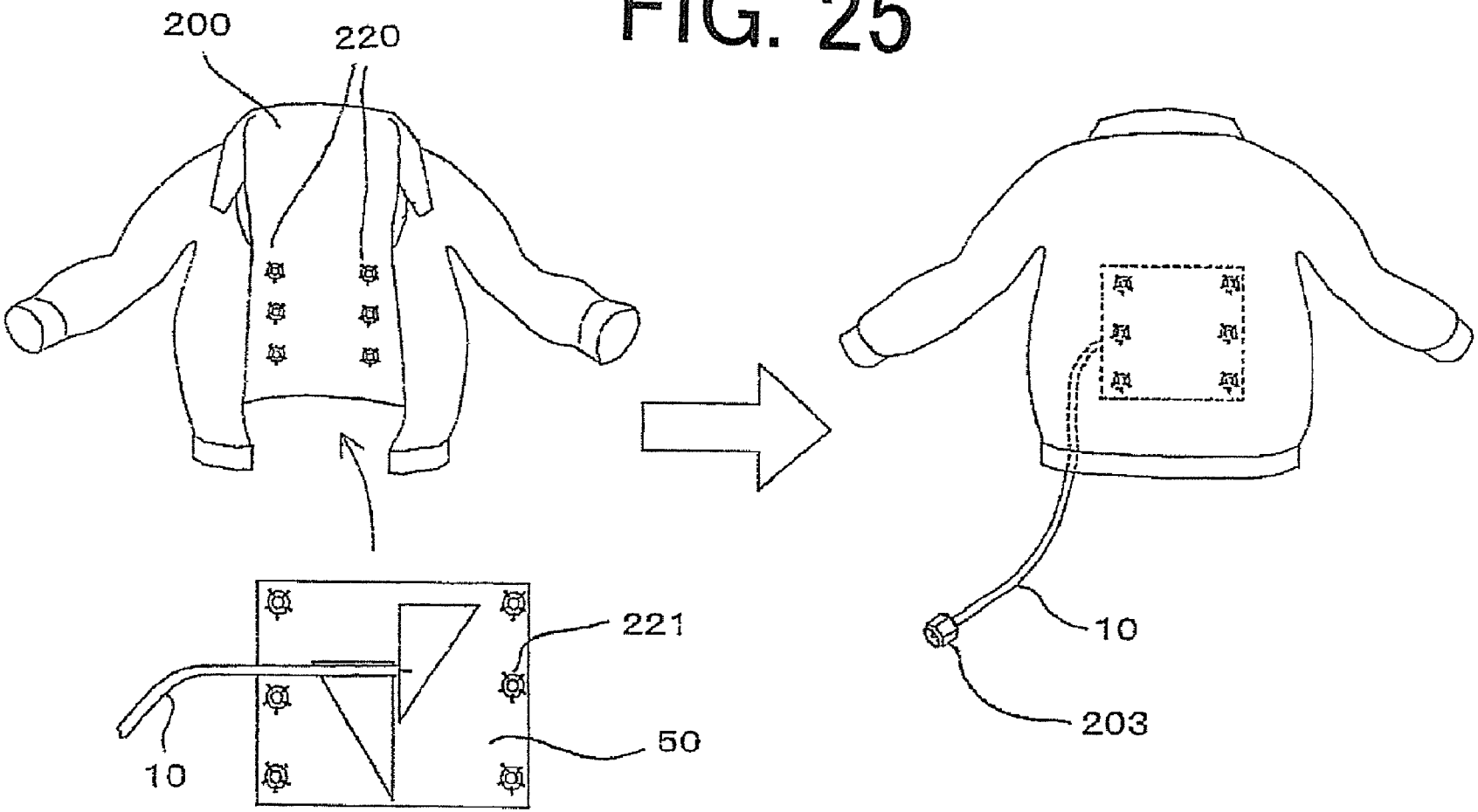
FIG. 25 is a diagram illustrating the configuration of a wideband antenna according to a sixteenth embodiment of the present invention.

FIG. 25 is a diagram illustrating the configuration of a wideband antenna according to a sixteenth embodiment of the present invention.

The difference between the configuration illustrated in FIG. 25 and the configuration illustrated in FIG. 24 is that the wideband antenna is attached to the wear 200 through buttons 220 and 221.

Incidentally, in the fourteenth to sixteenth embodiments, the described examples use the wear 200 that a user wears. However, the present embodiment is not limited to this. The wideband antenna may be attached to a hat that a user wears or a bag.

(17) Various Kinds of Measurement

Figure 26:
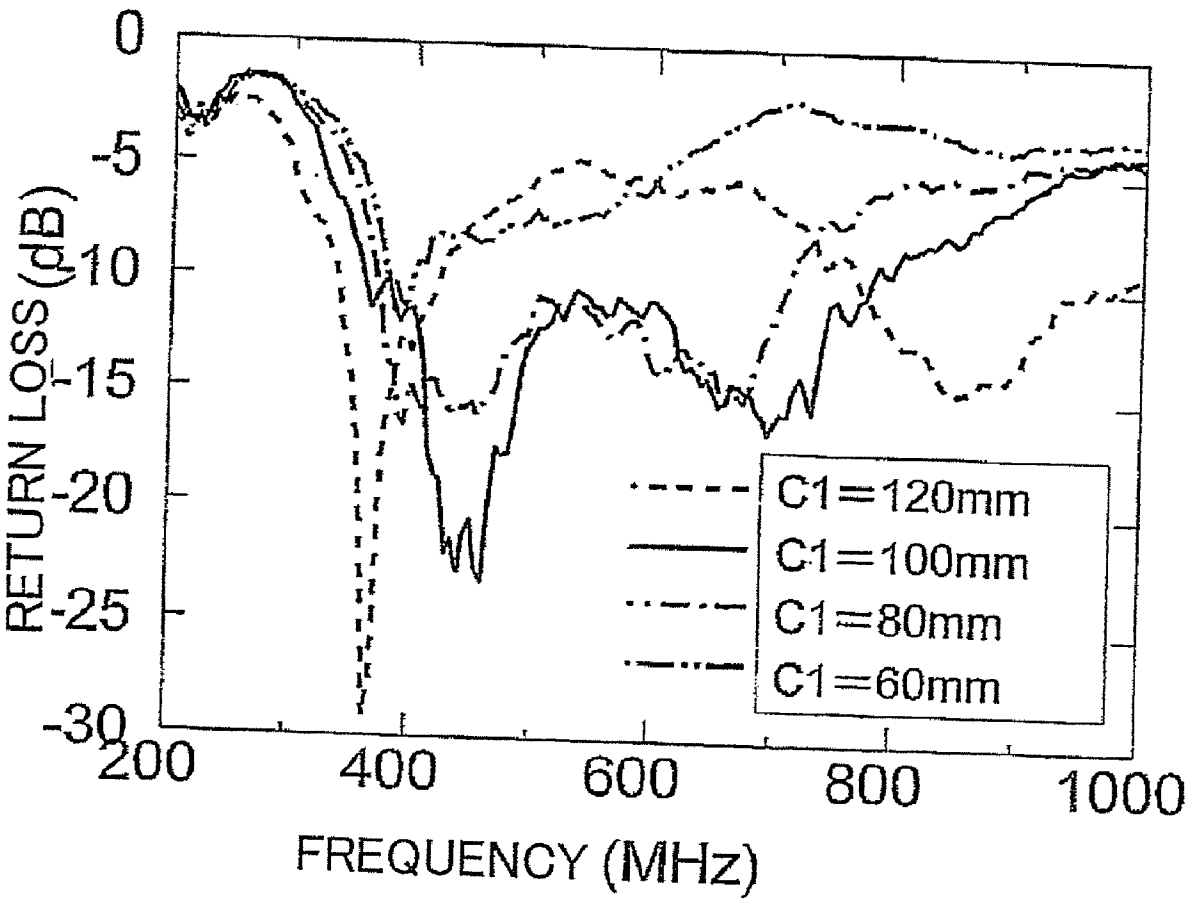
FIG. 26 illustrates the first measured return-loss characteristics of the wideband antennas according to the present invention.

FIG. 26 illustrates the actually measured values of return-loss characteristic with the test-manufactured wideband antennas according to the embodiments of the present invention.

In the embodiment of FIG. 6, the radiating elements 1 and 2 are formed in the same shape.

The material used for the radiating elements is a flexible printed circuit board.

The lowest usable frequency is at 420 MHz. At this time, the wideband antenna is designed so that the dimension A1 is one-quarter of the wavelength.

The dimensions are: A1=A2=180 mm, B1=B2=120 mm, and D=5 mm.

Moreover, the value C1 is changed by 20 mm in the range of 60 mm to 120 mm, and the return-loss characteristics are measured.

When C1 is 100 mm (the solid line), the characteristic of the widest band is obtained with the return-loss less than or equal to −9.5 dB. That is, in the band less than or equal to VSWR<2.0, what is obtained is 360 MHz to 780 MHz. In this case, the fractional bandwidth is about 74%, and the characteristic of an extremely wide band is obtained.

The result shows that according to the embodiment of the present invention, the wideband antenna is a wideband antenna that can be used in the broadband and that the impedance can be adjusted by controlling the value C1.

Figure 27:
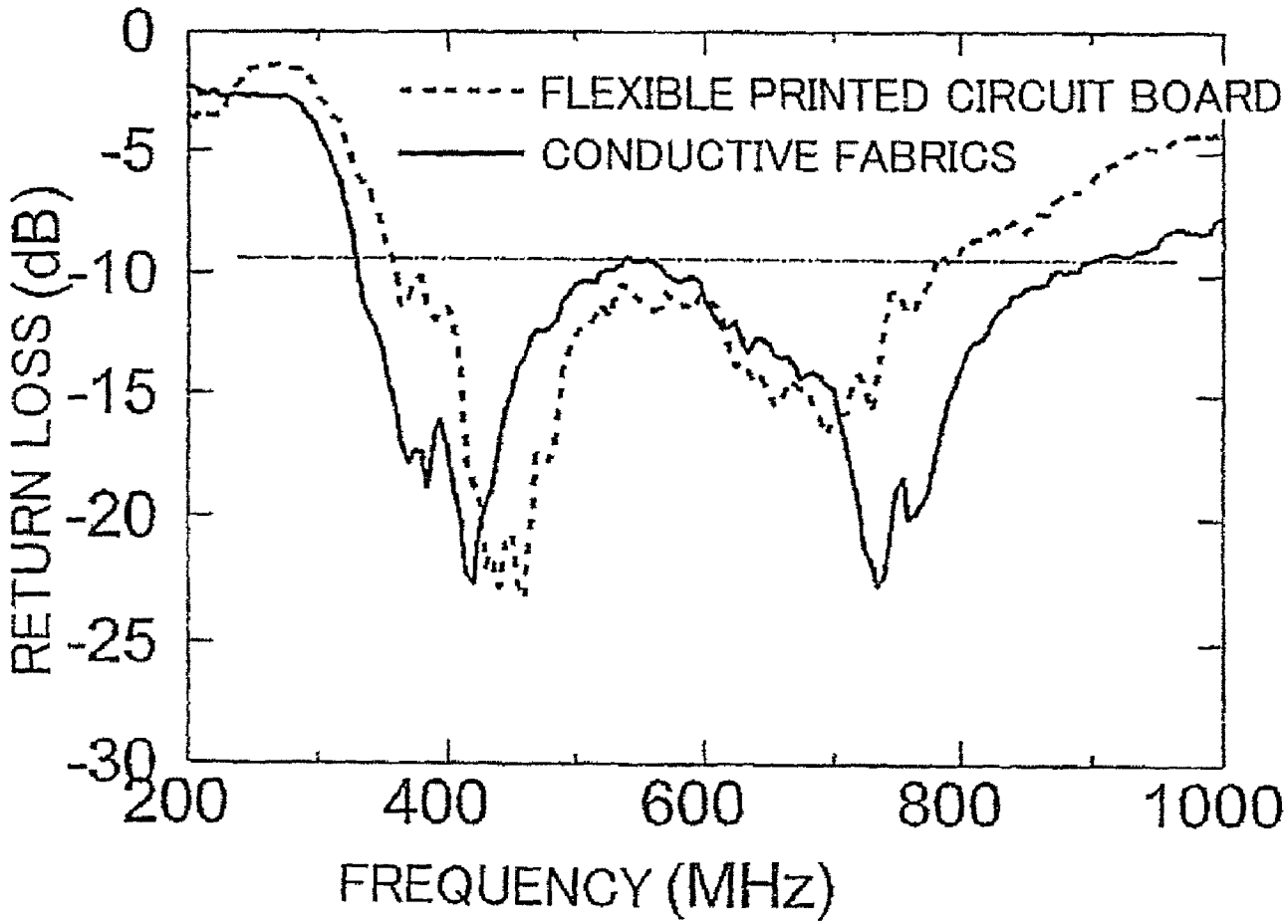
FIG. 27 illustrates the second measured return-loss characteristics of the wideband antennas according to the present invention.

FIG. 27 illustrates the result of comparison in return-loss characteristic in FIG. 26 between a case in which the radiating elements 1 and 2 are formed by a flexible printed circuit board (the dotted line) and a case in which the radiating elements 1 and 2 are formed by the conductive fabric (the solid line) of the ninth embodiment illustrated in FIGS. 13 and 14 to be the size of which is the same as that of the flexible printed circuit board, with C1 set at 100 mm.

Even though the methods of supplying electricity are different, the band of the return-loss characteristic of −9.5 dB has slightly widened.

The result of measurement shows that similar results are obtained even when the conductive fabric is used and that the electricity supply system shown in FIGS. 11 and 12 can adjust the impedance, thereby making it possible to further widen the band through appropriate adjustment.

Figure 28:
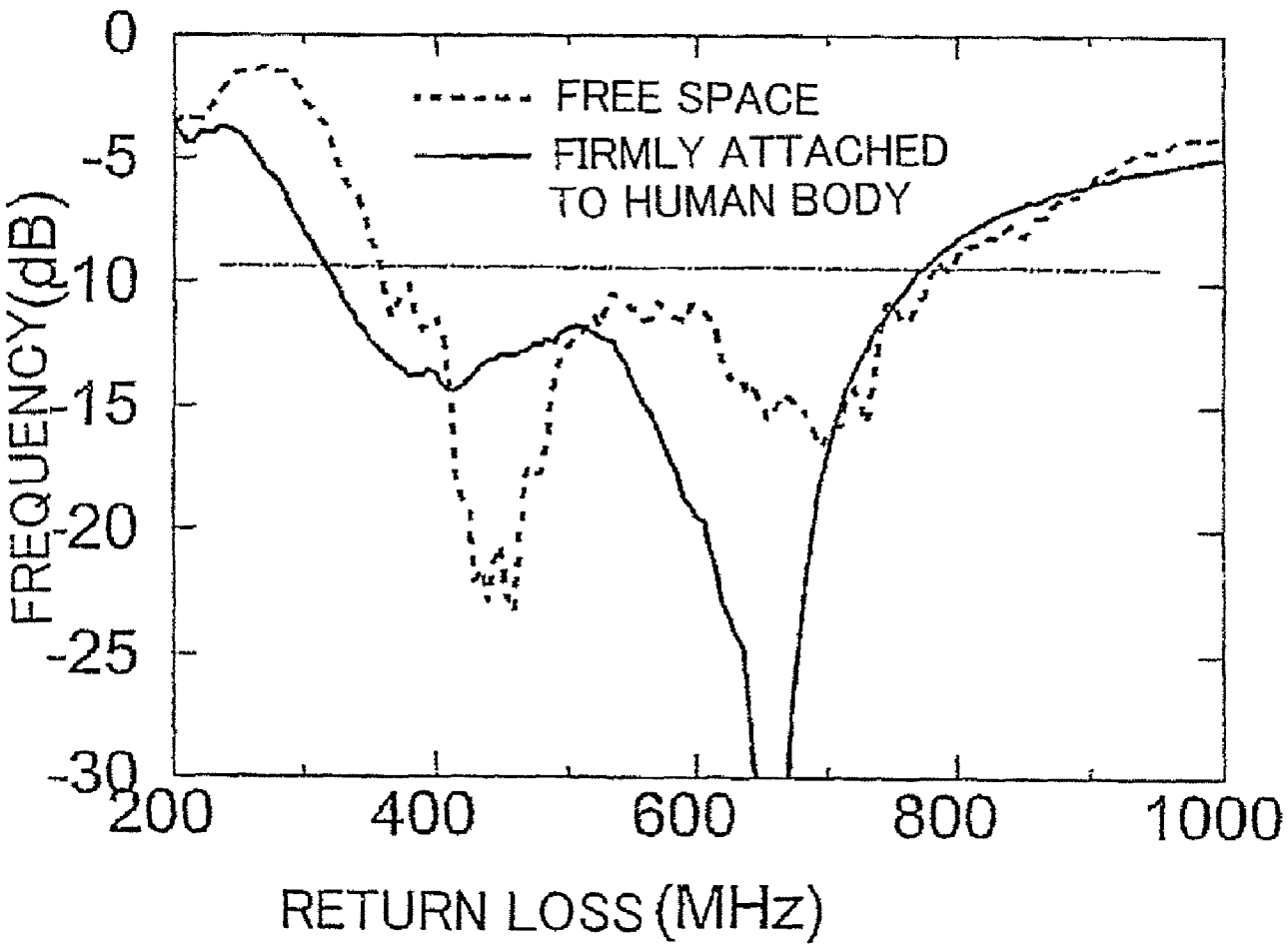
FIG. 28 illustrates the third measured return-loss characteristics of the wideband antennas according to the present invention.

FIG. 28 illustrates the return-loss characteristic of the wideband antenna that is formed by the flexible printed circuit board (the dotted line) of FIG. 26 and is used in a free space (described as "Free space" in the diagram) and the return-loss characteristic of the wideband antenna that is attached firmly to the clothing at the back of a human body (described as "Firmly attached to human body" in the diagram).

It is clear from FIG. 28 that the return-loss characteristic does not deteriorate even when the wideband antenna is attached firmly to the human body.

The result of measurement shows that according to the embodiment of the present invention, the wideband antenna is a wideband antenna the return-loss characteristic of which does not deteriorate even when the wideband antenna is attached firmly to the human body.

(18) Various Effects According to Embodiments of the Present Invention

As described above, the wideband antennas of the present invention have the following effects:

1) The wideband antennas are planar and thin antennas with a broadband (The example in which the fractional bandwidth is greater than or equal to 74% was confirmed by actual measurement).

2) The wideband antennas can be formed not only by conductive plates but by conductive films that can be bent or conductive fabrics.

3) When the wideband antenna is formed by a conductive fabric, the coaxial cable may not be fixed on the fabric with solder.

4) The wideband antenna can be placed near a human body in such a way that the wideband antenna is attached to the clothing or other goods that people wear.

5) The input impedance characteristic does not deteriorate even when the wideband antenna is placed near a human body. That is, even when a person wears the clothing to which the antenna is attached, the input impedance characteristic does not deteriorate and the antenna maintains the broadband characteristic.

In the above-described embodiments, the wideband antennas of the present embodiments are attached to the wear such as a blazer and a jacket. However, the wear includes a coat, a skirt, trousers, a muffler, and hats, to which the wideband antennas can be attached. Moreover, the wideband antennas can be attached not only to goods that people wear but to personal belongings, such as a bag, the side pocket of a bag, a knapsack, and a PC soft case. The wideband antenna can be attached to the surface or inner part of the personal belongings like the wear and the bag. The base on which the wideband antenna is mounted may just serve as a sheet antenna and can be put in the bag or the like.

In the examples described above, the radiating elements are formed substantially in the shape of a right triangle, including a trapezoid and a pentagon. However, the radiating elements may be formed in other shapes.

The above has described the representative embodiments of the present invention. However, the present invention may be embodied in other various forms without departing from the spirit or essential characteristics thereof as defined by the appended claims. The described embodiments are, therefore, to be considered only as illustrative and not restrictive. The scope of the present invention is indicated by the appended claims, and not restricted by the foregoing description and the abstract. All modifications and alterations which come within the meaning and range of equivalency of the claims are to be embraced within the scope of the present invention.

The invention claimed is:

1. A wideband antenna comprising:

a first radiating element and a second radiating element, each of the first and second radiating elements including at least one side and being in the shape of a flat plate; and a coaxial cable that supplies electricity to the first and second radiating elements, wherein one side of the first radiating element faces one side of the second radiating element so that the sides are parallel to each other, and the first and second radiating elements are so arranged as to be shifted from each other in the parallel direction;

at least one of the first and second radiating elements is connected to the coaxial cable via a power supply section; and the power supply section includes a conductor section and a dielectric material, and the coaxial cable is connected to one surface of the conductor section, the other surface of the conductor section being arranged on a surface of any one of the first and second radiating elements through the dielectric material.

2. The wideband antenna according to claim 1, wherein the first radiating element and the second radiating element are substantially in the same shape.

3. The wideband antenna according to claim 1, wherein if the side of the first radiating element is aligned with the side of the second radiating element, the sides substantially have line symmetry.

4. The wideband antenna according to claim 1, wherein the first radiating element and the second radiating element are substantially in the shape of a triangle.

5. The wideband antenna according to claim 1, wherein the first radiating element and the second radiating element each have a side that intersects with the side substantially at right angles.

6. The wideband antenna according to claim 4, wherein the first radiating element and the second radiating element are substantially in the shape of a right triangle.

7. The wideband antenna according to claim 1, wherein electricity is supplied to the first radiating element and the second radiating element at a position where the first and second radiating elements are so arranged as to be shifted from each other in the parallel direction.

8. The wideband antenna according to claim 6, wherein at least one of two corners, except a corner which is substantially a right angle, of each of the first and second radiating elements which are substantially in the shape of a right triangle is partially cut off.

9. The wideband antenna according to claim 1, wherein the first and second radiating elements are formed by a conductive material that can be bent.

10. The wideband antenna according to claim 1, wherein a coaxial central conductor of the coaxial cable is connected to the first radiating element via the power supply section, and a coaxial external conductor of the coaxial cable is connected to the second radiating element via the power supply section.

11. The wideband antenna according to claim 1, wherein the amount of the shift is adjusted in the range of 0.1 to 0.2 of the wavelength of the lowest usable frequency to be used.

12. The wideband antenna according to claim 1, wherein the power supply section is fixed on at least one of the first and second radiating elements with thread, hook and loop fasteners, hooks, or buttons.

13. The wideband antenna according to claim 1, wherein the first and second radiating elements are formed on a surface of a printed circuit board.

14. The wideband antenna according to claim 13, wherein the first radiating element is formed on one surface of the printed circuit board, and the second radiating element is formed on the other surface.

15. The wideband antenna according to claim 1, wherein the first and second radiating elements are formed by conductive fabrics.

16. Wear to which a wideband antenna claimed in claim 1 is attached.

17. Belongings to which a wideband antenna claimed in claim 1 is attached.

18. A wearable goods to which a wideband antenna claimed in claim 1 is attached.

* * * * *